US006345888B1

(12) United States Patent
Matsumoto et al.

(10) Patent No.: US 6,345,888 B1
(45) Date of Patent: Feb. 12, 2002

(54) LIQUID SUPPLY METHOD, SYSTEM, INK CONTAINER, CARTRIDGE AND REPLENISHING CONTAINER AND HEAD CARTRIDGE USABLE WITH SYSTEM

(75) Inventors: Hidehisa Matsumoto, Kawasaki; Shozo Hattori, Tokyo; Hiroyuki Ishinaga, Tokyo; Hirofumi Okuhara, Tokyo; Tomoyuki Kaneda, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/221,045

(22) Filed: Dec. 28, 1998

(30) Foreign Application Priority Data

Dec. 25, 1997 (JP) ..... 9-357306
Dec. 16, 1998 (JP) ..... 10-357624

(51) Int. Cl.[7] ..... B41J 2/175
(52) U.S. Cl. ..... 347/86; 347/85
(58) Field of Search ..... 347/84, 85, 86, 347/87; 220/495

(56) References Cited

U.S. PATENT DOCUMENTS 5,481,289 A * 1/1996 Arashima et al. ..... 347/93
5,975,330 A * 11/1999 Sasaki et al. ..... 220/495

FOREIGN PATENT DOCUMENTS

| | | | | |
|---|---|---|---|---|
| AU | 28297/92 | | 5/1993 | |
| AU | 42156/93 | | 2/1994 | |
| AU | 42160/93 | | 2/1994 | |
| AU | 44317/93 | | 2/1994 | |
| AU | 70372/94 | | 4/1995 | |
| AU | 70323/94 | | 5/1995 | |
| AU | 50803/96 | | 10/1996 | |
| AU | 50854/96 | | 11/1996 | |
| AU | 45230/97 | | 5/1998 | |
| EP | 580433 | * | 1/1994 | |
| EP | 581531 | * | 2/1994 | |
| EP | 719646 | * | 7/1996 | |
| EP | 0738605 A2 | * | 10/1996 | ..... B41J/2/175 |
| EP | 738605 | * | 10/1996 | |
| EP | 803364 | | 10/1997 | |
| JP | 7-68776 | | 3/1995 | |
| JP | 7068778 A | * | 3/1995 | ..... B41J/2/175 |
| JP | 8-34122 | | 2/1996 | |
| JP | 10-175311 | * | 6/1998 | |
| WO | 97/16314 | | 5/1997 | |

* cited by examiner

*Primary Examiner*—Anh T. N. Vo
(74) *Attorney, Agent, or Firm*—Fitzpatrick, Cella, Harper & Scinto

(57) ABSTRACT

A liquid supply method includes a step of preparing a negative pressure producing material chamber, including a liquid supply portion for permitting supply of the liquid to an outside and an air vent for fluid communication with ambience, for accommodating a negative pressure producing member for retaining the liquid; a step of preparing a liquid containing chamber having a liquid containing portion for accommodating the liquid, the liquid containing portion forming a substantially sealed space except for fluid communication with the negative pressure producing material chamber; a first liquid supply step of permitting supply of the liquid to the outside by permitting movement of the liquid into the negative pressure producing material chamber from the liquid containing portion without introduction of the air into the liquid containing chamber with a negative pressure while permitting decrease of a volume of the liquid containing portion; a second liquid supply step, after the first liquid supply step, of permitting supply of the liquid to the outside by permitting movement of the liquid into the negative pressure producing material chamber from the liquid containing portion with introduction of the air into the liquid containing portion.

31 Claims, 20 Drawing Sheets

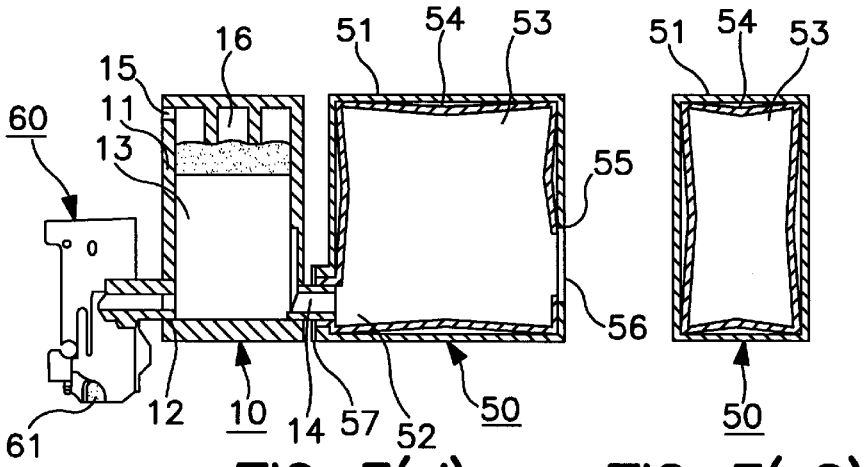
FIG. 3(a1)
FIG. 3(a2)
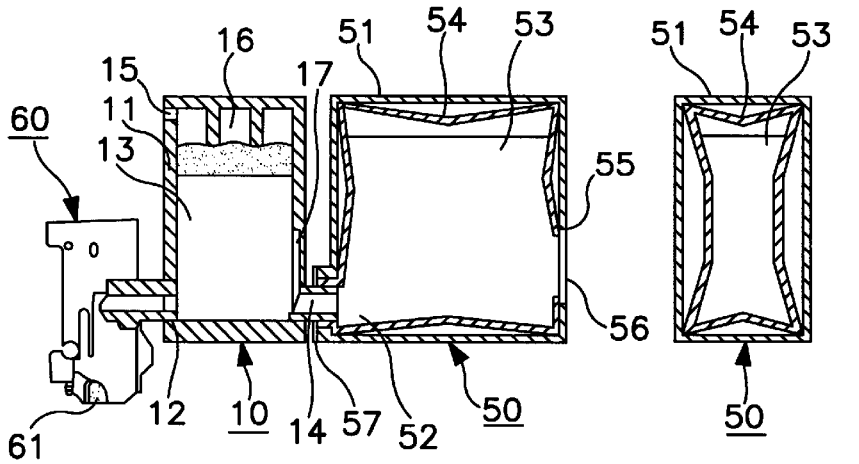
FIG. 3(b1)
FIG. 3(b2)
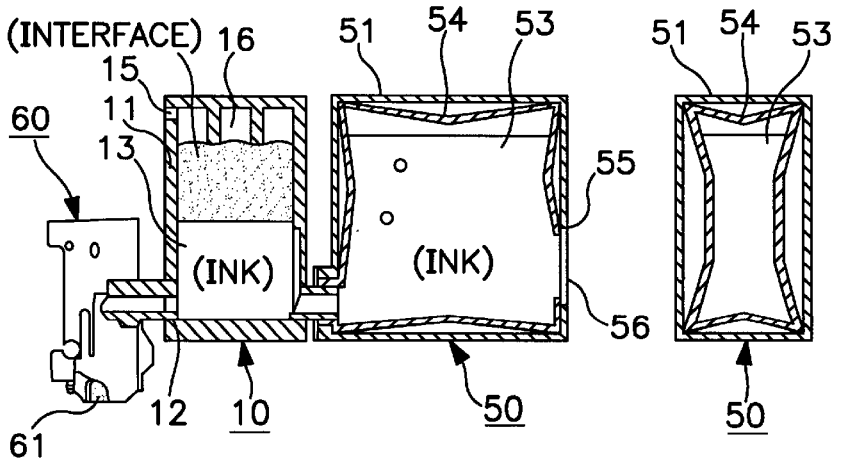
FIG. 3(c1)
FIG. 3(c2)

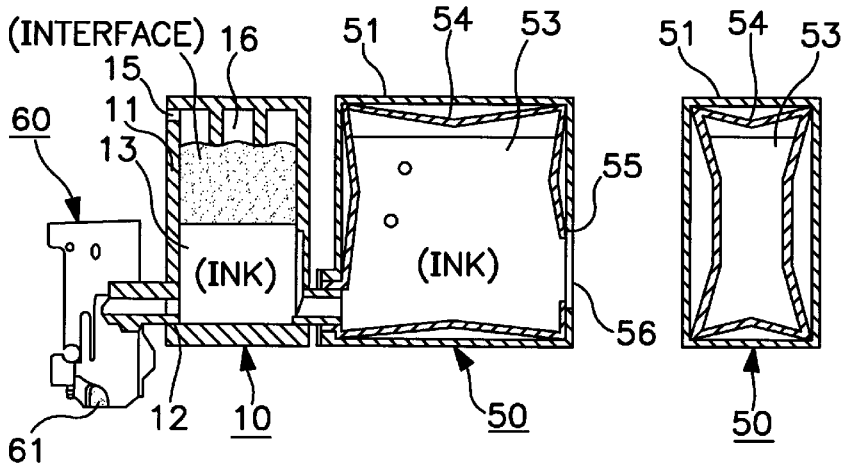
FIG. 4(a1)
FIG. 4(a2)
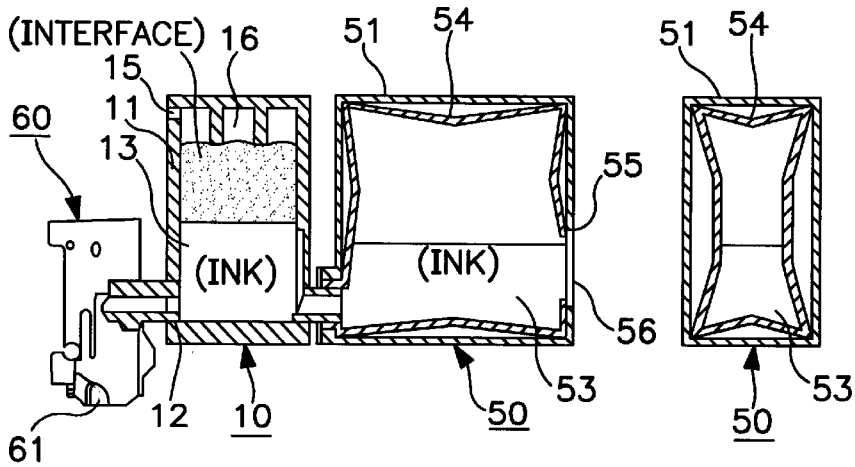
FIG. 4(b1)
FIG. 4(b2)
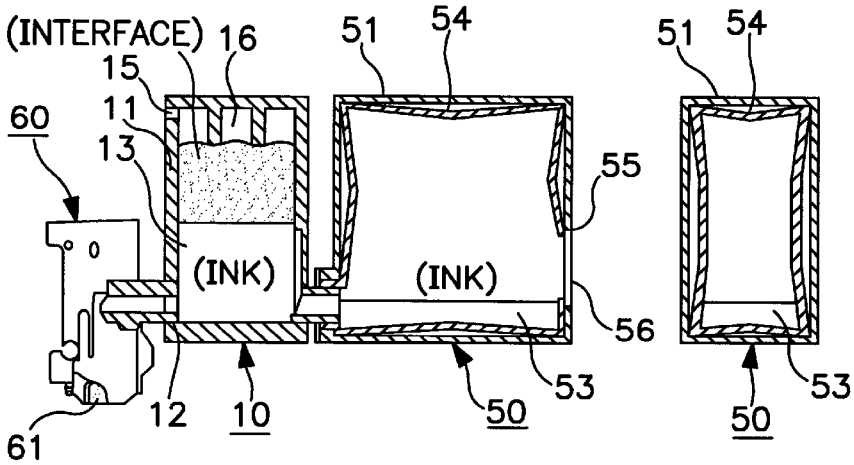
FIG. 4(c1)
FIG. 4(c2)

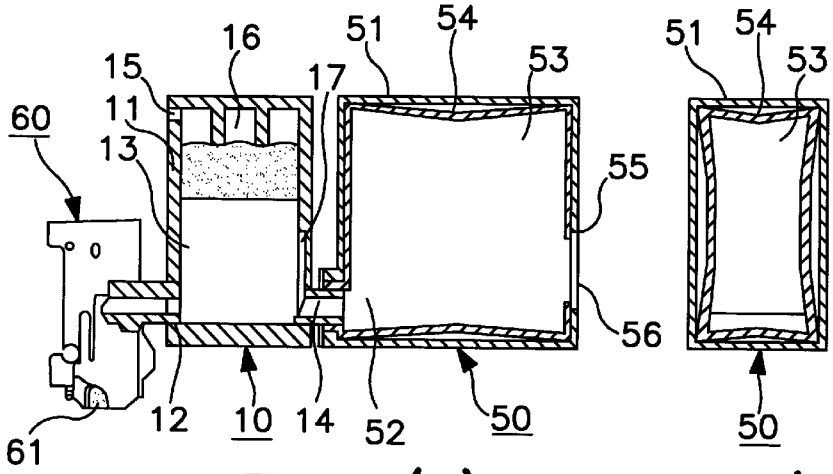
FIG. 5(a1)
FIG. 5(a2)
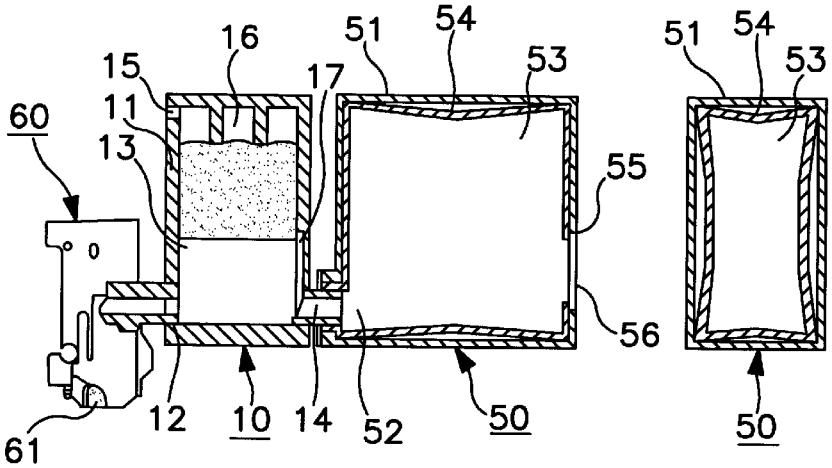
FIG. 5(b1)
FIG. 5(b2)
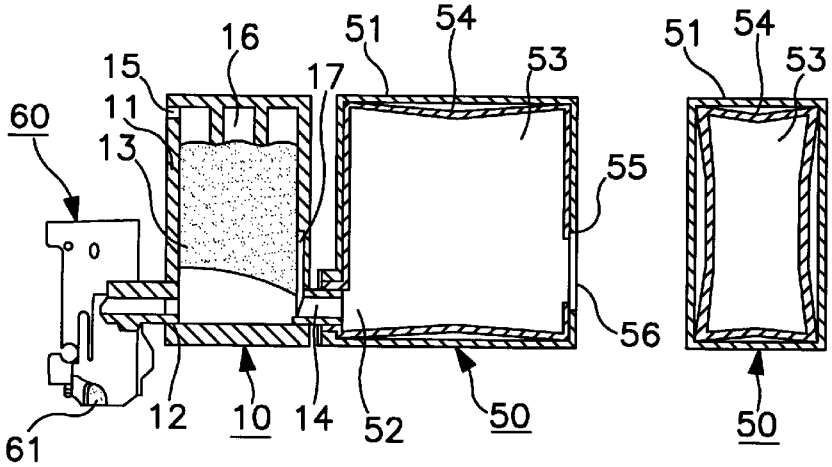
FIG. 5(c1)
FIG. 5(c2)

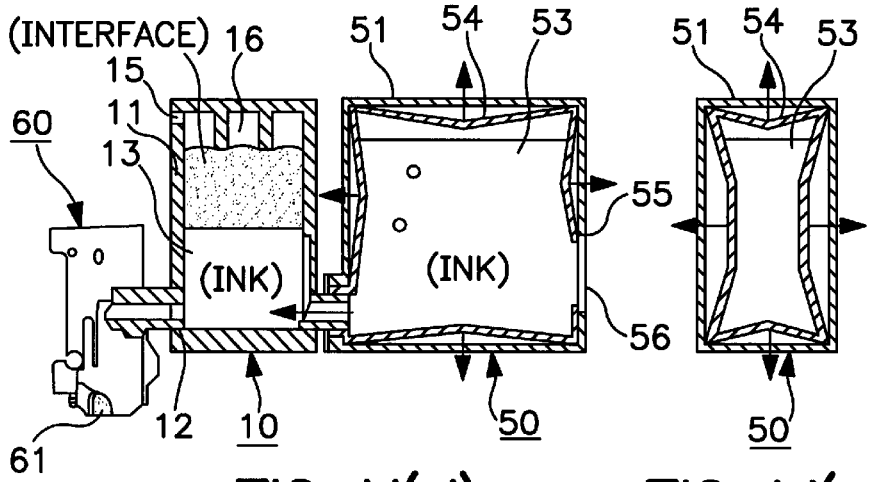
FIG. 11(a1)
FIG. 11(a2)
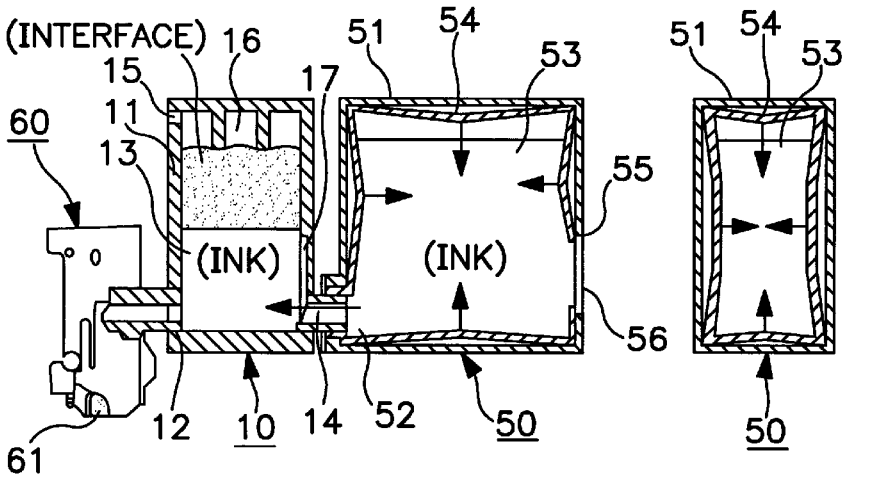
FIG. 11(b1)
FIG. 11(b2)
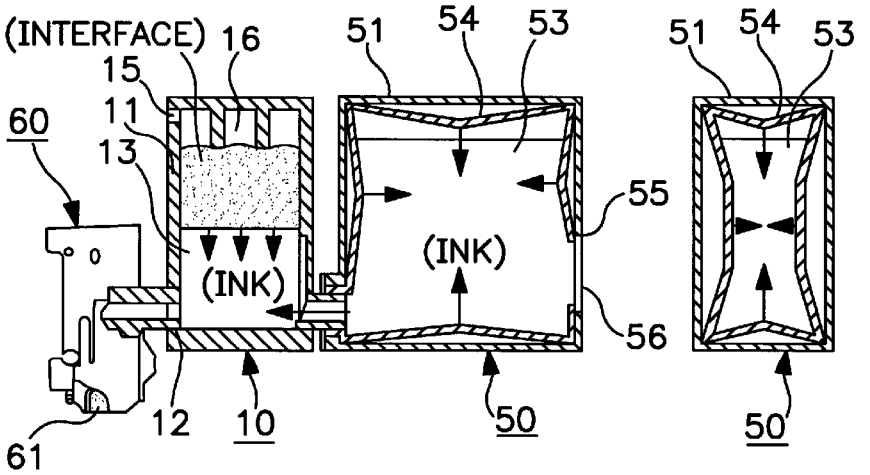
FIG. 11(c1)
FIG. 11(c2)

LIQUID SUPPLY METHOD, SYSTEM, INK CONTAINER, CARTRIDGE AND REPLENISHING CONTAINER AND HEAD CARTRIDGE USABLE WITH SYSTEM

FIELD OF THE INVENTION AND RELATED ART

The present invention relates to a liquid supply method and a liquid supply system using a negative pressure to supply liquid to an outside, and more particularly to a liquid supply method usable with a liquid ejection recording apparatus which effects printing on recording material using a recording head to which liquid is supplied, a liquid supply system, an exchange liquid accommodating container and head cartridge usable with such a system.

Conventionally, a liquid supply method using a negative pressure for supplying liquid to the outside is known in an ink jet recording apparatus field, wherein for example an ink container for permitting supply of liquid to an ink ejection head with a negative pressure, and wherein the ink container is made integral with the recording head ((head cartridge). The head cartridge is classified into a type wherein the recording head and the ink container (ink accommodating portion) are normally integral, and a type wherein the recording means and the ink accommodating portion are separate, which are both separable relative to the recording device, and are made integral when they are used.

In such a liquid supply system, the easiest way of producing the negative pressure is to use capillary force of a porous material. The ink container of this type is provided with a porous material such as sponge which is accommodated preferably under compression and which occupies the entirety of the inside of the container, and with an air vent for permitting smooth ink supply by introduction of the air during the printing. However, this type involves a problem that ink accommodation efficiency per unit voltage is low since the porous member is used to retain the ink. EP0580433 which has been assigned to the assignee of this application has proposed an Ink container including a negative pressure producing material chamber, an ink accommodating chamber (reservoir) and a fluid communication part therebetween, wherein the ink accommodating chamber is substantially hermetically sealed, and the negative pressure producing material chamber is open to the ambience. EP0581531 also proposes a structure wherein the above-described o is exchangeable.

Such an ink container is advantageous in that air is permitted go into the ink accommodating chamber with discharge of the ink from the ink accommodating chamber into the negative pressure producing material chamber (air-liquid exchanging operation), so that ink can be supplied to the outside with a substantially constant negative pressure during the air-liquid exchanging operation.

EP0738605 which has been assigned to the assignee of this application proposes a liquid accommodating container including a casing having a substantially prism configuration, and a liquid accommodating portion which is deformable with discharge of the liquid therefrom said accommodating portion having an outer shape similar or equivalent to an inner shape of the casing, wherein in each side of the prism-like shape, the thickness at the corner portions of the side is smaller than the central portion thereof. In the liquid accommodating container, the accommodating portion deforms or contracts with the discharge of the liquid (without air-liquid exchange) so that liquid is supplied with the negative pressure. This container is advantageous in that position of the ink container is not limited as compared with an ink containing bladder which is conventional. Additionally, since the ink is directly retained (substantially without use of porous material), the ink accommodation efficiency is high.

SUMMARY OF THE INVENTION

The ink container of the type having the negative pressure producing material chamber and the ink accommodating chamber has a fixed accommodation space. In order to discharge the ink therefrom into the negative pressure producing material chamber, air-liquid exchange is used, by which the air is introduced into the ink accommodating chamber. Therefore, when the ink is supplied out into the negative pressure producing material chamber, the corresponding amount of the air is introduced, so that ink accommodating chamber contains both of the air and the ink. The air may expands due to the ambient condition change (temperature variation during 24 hours) with the result that ink is discharged into the negative pressure producing material chamber from the ink accommodating chamber. Therefore, a buffer space has to be provided in the negative pressure producing member or material in consideration of a practically maximum volume determined by the expansion and the resulting amount of ink motion in various conditions. In the conventional air-liquid exchanging operation, the ink discharge from the ink accommodating chamber into the negative pressure producing material chamber is directly interrelated with the introduction of the air through the communicating portion, and therefore, when a large amount of the ink is discharged from the negative pressure producing material chamber to the outside (liquid ejecting head) in a short period of time, the ink supply from the ink accommodating chamber into the negative pressure producing material chamber with the air-liquid exchanging operation is unlikely to follow the abrupt ink consumption.

Accordingly, it is a principal object of the present invention to provide a liquid supply method, a liquid supply system, an ink container and an ink jet cartridge wherein the ink is contained in the negative pressure producing material chamber and the ink accommodating chamber (reservoir) and wherein the volume of the buffer space required by the negative pressure producing material chamber can be reduced even in view of various conditions, can be reduced, and the ink supply is carried out with a stable negative pressure during use of the ink in the ink accommodating chamber while permitting large expansion of the air introduced by the air-liquid exchange.

It is another object of the present invention to provide a liquid supply system and a liquid container usable with the system wherein the ink accommodating chamber (liquid accommodating container) is exchangeable in addition to or independently of the first object.

It is a further object of the present invention to provide a related devices such as a head cartridge related with the liquid supply method and the liquid supply system. The inventors have analyzed in detail the ink accommodating chamber containing the air in an ink container having the negative pressure producing material chamber, the ink accommodating chamber and the communication port therebetween. The supply of the ink from the ink accommodating chamber into the negative pressure producing material chamber occurs in interrelation with the introduction of the air.

The expansion of the air in the ink accommodating chamber is unavoidable, but the inventors have considered allowing the expansion of the air in the ink accommodating chamber.

It is a further object of the present invention to provide a According to an aspect of the present invention, there is provided a liquid supply method comprising a step of preparing a negative pressure producing material chamber, including a liquid supply portion for permitting supply of the liquid to an outside and an air vent for fluid communication with ambience, for accommodating a negative pressure producing member for retaining the liquid; a step of preparing a liquid containing chamber having a liquid containing portion for accommodating the liquid, said liquid containing portion forming a substantially sealed space except for fluid communication with the negative pressure producing material chamber; a first liquid supply step of permitting supply of the liquid to the outside by permitting movement of the liquid into said negative pressure producing material chamber from said liquid containing portion without introduction of the air into the liquid containing chamber with a negative pressure while permitting decrease of a volume of said liquid containing portion; a second liquid supply step, after said first liquid supply step, of permitting supply of the liquid to the outside by permitting movement of the liquid into said negative pressure producing material chamber from said liquid containing portion with introduction of the air into the liquid containing portion.

According to this method, the liquid containing portion deforms while maintaining a balance in the negative pressure with the negative pressure producing member. Therefore, even if the air expands in the liquid containing portion due to the ambient condition change, the liquid containing portion restores its shape upon an abrupt change so that influence of the change can be decreased. If the change is not abrupt, the influence of the expansion can be decreased by both of the negative pressure producing member and the liquid containing portion while the balance is eventually maintained with the negative pressure producing member. Therefore, the voltage of the buffer space in the negative pressure producing material chamber can be reduced even in view of various use condition.

In the second liquid supply process, the air is introduced into the liquid containing portion, so that liquid in the liquid containing portion is used up substantially without an unusable remaining amount ink, and the negative pressure difference between at the time of the start of the liquid discharge from the liquid containing portion and at the time of the end thereof, can be smaller than that when the liquid containing portion alone is used as a negative pressure producing container. As compared with the conventional type ink container having the negative pressure producing material chamber, the ink accommodating chamber and the communication port therebetween, the allowance to the air expansion is larger. Even if a large amount of the ink is consumed in a short period of time, the liquid supply from the liquid containing portion into the negative pressure producing material chamber is smooth since the liquid containing portion is deformable. Therefore, the ink supply is stabilized when the ink in the liquid containing portion is consumed. According to another aspect of the present invention, there is provided a liquid supply system, using a liquid supply container including a liquid containing portion for accommodating liquid in a sealed space; a negative pressure producing material container, which accommodating container is detachably mountable relative to the liquid supply container and which is capable of effecting air-liquid exchange wherein air is introduced into said liquid containing portion, and the liquid is discharged through a communicating portion communicating with said liquid accommodating portion; the improvement comprising: said liquid containing portion of said liquid supply container is capable of producing a negative pressure while deforming; and wherein when the liquid supply container is mounted to said negative pressure producing material chamber, the liquid is permitted to move from said liquid containing portion into said negative pressure producing material chamber.

According to this system, even if the accommodating container for the negative pressure producing material does not contain the liquid in the neighborhood of the communicating portion to the liquid accommodating container, the liquid can be moved from the liquid accommodating container into the negative pressure producing member using the capillary force in the negative pressure producing material chamber upon the mounting of the liquid accommodating container to the negative pressure producing material chamber, so that liquid in the exchanged liquid accommodating container can be assuredly used by the simple mounting, irrespective of the liquid retaining state of the negative pressure producing member adjacent the connecting portion. Thus, a practical liquid supply system with stabilized liquid supply can be provided.

By movement in a part of the liquid in the liquid containing portion into the negative pressure producing material container upon the connection, the liquid containing portion is deformed, and therefore, influence of the expansion of the air in the liquid containing portion due to the ambient condition change can be eased. The present invention provides an ink container and an ink jet cartridge usable with the liquid supply method and the liquid supply system.

More particularly, according to a further aspect of the present invention, there is provided a liquid container, comprising a negative pressure producing material chamber, including a liquid supply portion for permitting supply of the liquid to an outside and an air vent for fluid communication with ambience, for accommodating a negative pressure producing member for retaining the liquid; a liquid containing chamber having a liquid containing portion for accommodating the liquid, said liquid containing portion forming a substantially sealed space except for fluid communication with the negative pressure producing material chamber; wherein said liquid containing portion deforms with discharge of the liquid therefrom while producing a negative pressure.

The ink jet cartridge provided by the present invention comprises the above-described ink container and a recording head for effecting recording by ejecting the liquid to the outside. Further, the present invention provides an exchange liquid accommodating container usable with the liquid supply system.

More particularly, there is provided a liquid accommodating container detachably mountable relative to a negative pressure producing material container, having a liquid supply portion for supplying liquid to an outside and an air vent for fluid communication with ambience, for accommodating a negative pressure producing member for retaining the liquid, comprising a liquid containing portion for accommodating the liquid, which forms a substantially sealed space except for fluid communication with the negative pressure producing material chamber; and sealing means for sealing said communicating portion relative to said negative pressure producing material chamber.

Furthermore, there is provided a liquid accommodating container detachably mountable relative to a negative pressure producing material container, having a liquid supply portion for supplying liquid to an outside and an air vent for fluid communication with ambience, for accommodating a negative pressure producing member for retaining the liquid, comprising a liquid containing portion for accommodating the liquid, which forms a substantially sealed space except for fluid communication with the negative pressure producing material chamber; and a casing having an inner shape equivalent or similar to an outer shape of said liquid containing portion and having an air vent for introducing the ambience; sealing means for sealing said communicating portion relative to said negative pressure producing material chamber.

The present invention is suitably applicable to a head cartridge used in an ink jet recording field.

More particularly, there is provided a head cartridge comprising a recording head for ejecting the liquid; a negative pressure producing material chamber, including a liquid supply portion for permitting supply of the liquid to said recording head and an air vent for fluid communication with ambience, for accommodating a negative pressure producing member for retaining the liquid; a liquid containing chamber having a liquid containing portion for accommodating the liquid, said liquid containing portion forming a substantially sealed space except for fluid communication with the negative pressure producing material chamber; and wherein said liquid containing portion deforms with discharge of the liquid therefrom while producing a negative pressure; wherein said recording head and said negative pressure producing material chamber are integral with each other.

A further aspect of the present invention provides a further method. More particularly, it provides a liquid supply method comprising a step of preparing a negative pressure producing material chamber, including a liquid supply portion for permitting supply of the liquid to an outside and an air vent for fluid communication with ambience, for accommodating a negative pressure producing member for retaining the liquid; a step of preparing a liquid containing chamber having a liquid containing portion for accommodating the liquid, said liquid containing portion forming a substantially sealed space except for fluid communication with the negative pressure producing material chamber; a step of moving the liquid from said liquid containing portion into said negative pressure producing material chamber without introduction of air into said liquid containing chamber with a negative pressure while permitting decrease of a volume of said liquid containing portion.

According to this method, the liquid in the liquid containing portion is usable without introduction of the air into the liquid containing portion, and therefore, even if the limitation to the inside volume of the liquid containing chamber is eased, change of the ambience is accommodatable.

In this specification, the negative pressure producing material container and the liquid accommodating container are generally used where they are separable from each other, and the negative pressure producing material chamber and the liquid containing chamber are used when they are separable or not separable.

The region not filled with the liquid adjacent the air vent of the first chamber means a part the negative pressure producing member not filled with the ink as well as the space not having the negative pressure producing member (buffer portion).

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 3(*a*1)–3(*c*2) are schematic illustrations for illustrating a first ink supply state in the ink container shown in FIG. 1.

FIGS. 4(*a*1)–4(*c*2) are schematic illustrations for illustrating a second ink supply state (air-liquid exchanging state) the ink container shown in FIG. 1.

FIGS 5(*a*1)–5(*c*2) are schematic illustrations illustrating a change in the container when the liquid is discharged after the second ink supply state shown in FIGS. 1(*a*)–1(*b*).

FIG. 7(*b*) shows a change of an amount of ink discharge from an ink accommodating portion and an amount of introduced air into the ink accommodating portion with time when the air is continuously discharged.

FIGS. 11(*a*1)–11(*c*2) are illustrations of operation of an ink container at to B region shown in FIGS. 7(*a*)–7(*b*).

DESCRIPTION OF THE PREFERRED EMBODIMENTS

Referring to the accompanying drawings, the embodiments of the present invention will be described. In the following descriptions, ink is taken as an example of the liquid usable with the liquid supply method and the liquid supply system according to the present invention, but the present invention is not limited to the ink but is usable with processing liquid to be applied on the recording material in the ink jet recording field, for example.

(First Embodiment)

Figure 1A:
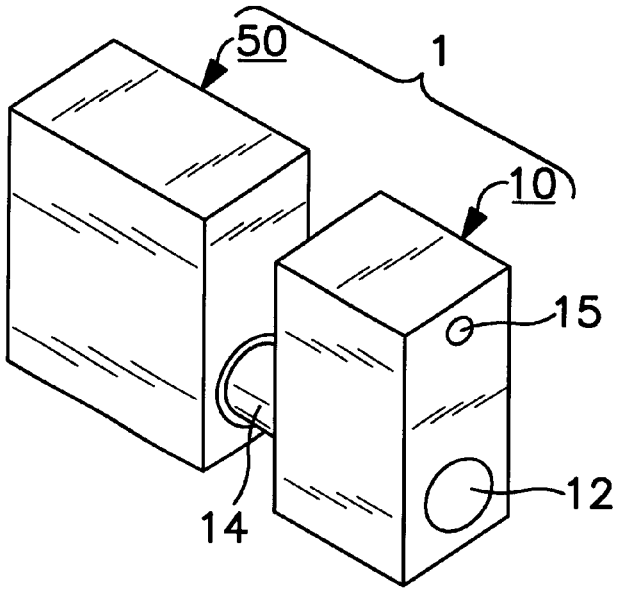
FIGS. 1(*a*) and 1(*b*) are schematic illustration of an ink container applicable with a liquid supply system according to a first embodiment of the present invention, wherein FIG. 1(*a*) is a perspective view thereof, and FIG. 1(*b*) is a sectional view thereof.
Figure 1B:
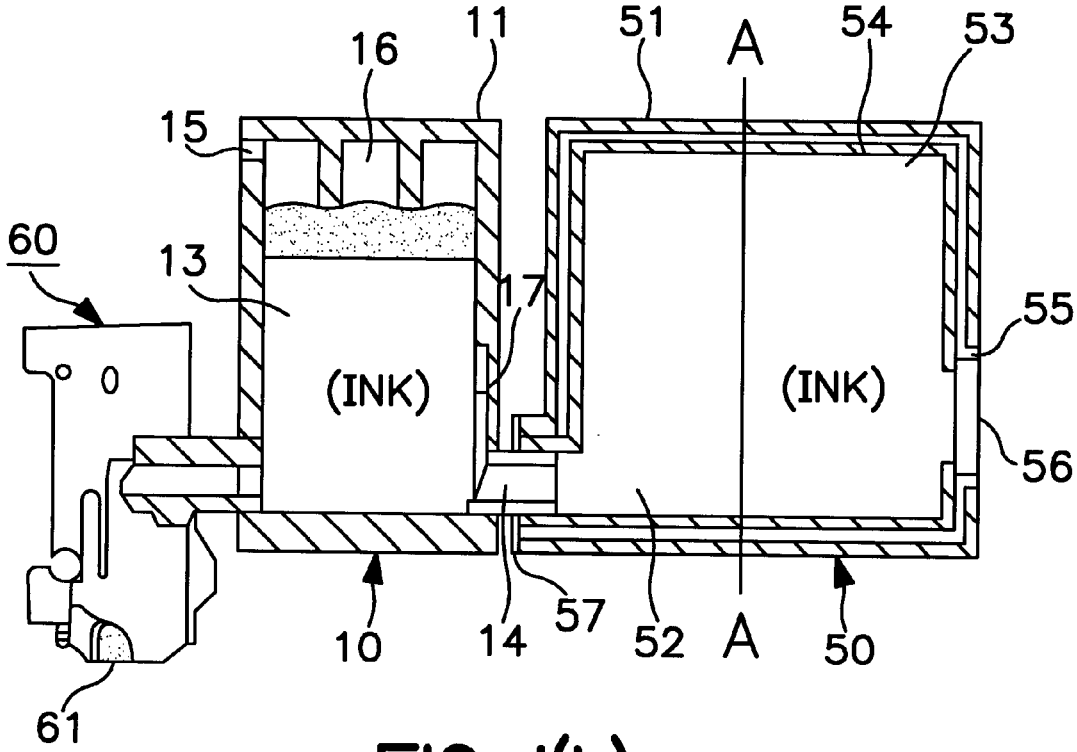

FIGS. 1(*a*) and 1(*b*) are schematic illustrations of an ink container applicable with a liquid supply system according to a first embodiment of the present invention, wherein FIG. 1(*a*) is a perspective view thereof, and FIG. 1(*b*) is a sectional view thereof.

The ink container 1 comprises an accommodating chamber for the negative pressure producing material 10 and an ink accommodating chamber 50, and the ink accommodating chamber 50 is separable from the negative pressure producing material chamber 10 through a communication tube(air-liquid exchange passage) 14. The negative pressure producing material chamber 10 a casing member 11 having an ink supply port 12 for supplying the ink (or processing liquid or the like) into an outside means such as a recording head 60 for effecting recording by ejecting liquid through an ejection outlet 61, a negative pressure producing member or material 13 of porous member or material such as polyurethane foam accommodated therein, and a communication tube (air-liquid exchange passage) 14, contacted to the negative pressure generating member, for introducing liquid from the second chamber. The casing 11 comprises an ambience introducing groove 17, on an inside of the communication tube, for promoting air-liquid exchange which will be described hereinafter, an air vent 15 for fluid communication between the ambience and the negative pressure producing member accommodated therein, and there is provided a buffer portion 16 in the form of a rib projected from the inner surface of the casing adjacent the air vent 15. In the embodiment, the air-liquid exchange passage 14 is contacted to the negative pressure producing member 13, and the end thereof communicates with the air introducing groove 17, so that smooth liquid supplying operation which will be described hereinafter is accomplished.

On the other hand, the ink accommodating chamber 50 comprises a casing member(outer wall) 51 constituting a chamber, and ink accommodating portion 53, constituted by a wall(inner wall) 54 having an inner surface similar to or equivalent to the inner surface of the casing member, for accommodating the ink therein, an ink discharging outlet 52 communicating with the air-liquid exchange passage 14 of the accommodating chamber for the negative pressure producing material, for discharging the liquid from the liquid containing portion 53 into the negative pressure producing material chamber. In this embodiment, an unshown seal member such as an O-ring is provided at a connecting portion between the ink discharging outlet 52 and the air-liquid exchange passage 14, by which the ink leakage and the introduction of the ambience through the connecting portion, is prevented. The seal member is satisfactory if it is provided at one of the ink accommodating chamber and the negative pressure producing material chamber, or it may be provided at each of them to enhance the sealing property. It may be provided independently of the ink accommodating chamber and the negative pressure producing material chamber, and it may be engaged with the connecting portions of them upon necessity. The inner wall 54 has a flexibility, and the ink accommodating portion 53 is deformable with the discharge of the ink accommodated therein. The inner wall 54 has a welded portion(pinch-off portion) 56, and the inner wall is supported on the outer wall with engagement therebetween at the welded portion. The outer wall is provided with an ambience communication port 55 to permit introduction of the ambience to between the inner wall and the outer wall.

In FIGS. 1(*a*) and 1(*b*) and the subsequent cross-sectional Figures, the hatched portion indicates the region of the negative pressure producing member retaining the ink. The cross-hatched portion indicates the ink contained in the space such as the ink accommodating portion, the air introducing groove and the air-liquid exchange passage. The ink accommodating chamber of this embodiment is defined by 6 flat surfaces which constitute a substantially rectangular parallelopiped configuration, to which a cylindrical ink discharging outlet 52 is added in the form of a curved surface, and the maximum area side of the rectangular parallelopiped configuration is indirectly shown in FIGS. 1(*a*) and 1(*b*). The thickness of the internal wall surface 53 is thinner in the portion constituting the apex portions, which will be called corner portions (including the rounded corner with small radius of curvature) than the central region of each of the sides of the rectangular parallelopiped shape, and the thickness gradually decreases from the central region of each of the sides toward the corner portions, and the configuration is convex inwardly of the ink accommodating portion. The direction is the same as the direction of deformation of the sides, so that deformation is promoted, as will be described hereinafter.

Each of the corner portions of the inner wall is constituted by three sides, so that strength of the entirety of the corner portions of the inner wall is greater than that of the central regions. As seen from an extension of the sides, since the thickness of the corner portions is smaller than of the central region, movement of the sides are permitted. It is desirable that portions constituting the corner portions of the inner walls have substantially equivalent thicknesses. Since FIGS. 1(*a*)–1(*b*) are relatively schematic, there is a space between the outer wall 51 of the ink accommodating chamber and the inner wall 52 thereof, but they may be contacted to each other or spaced from each other, if they are separable.

Figure 2:
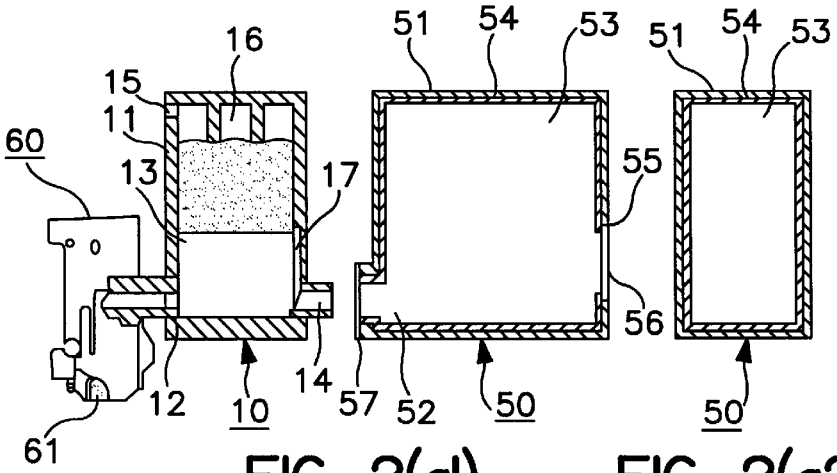
FIGS. 2(*a*1)–2(*c*2) are schematic illustrations of an ink accommodating chamber and an accommodating chamber for a negative pressure producing material when they are connected.
Figure 2:
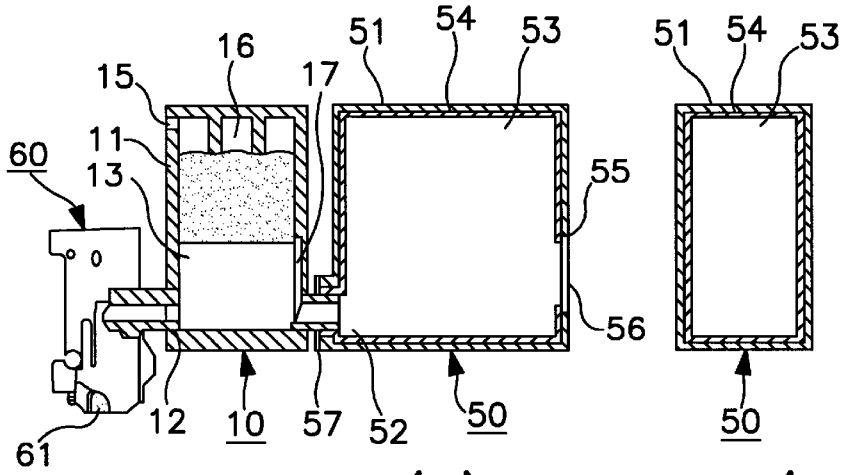
Figure 2:
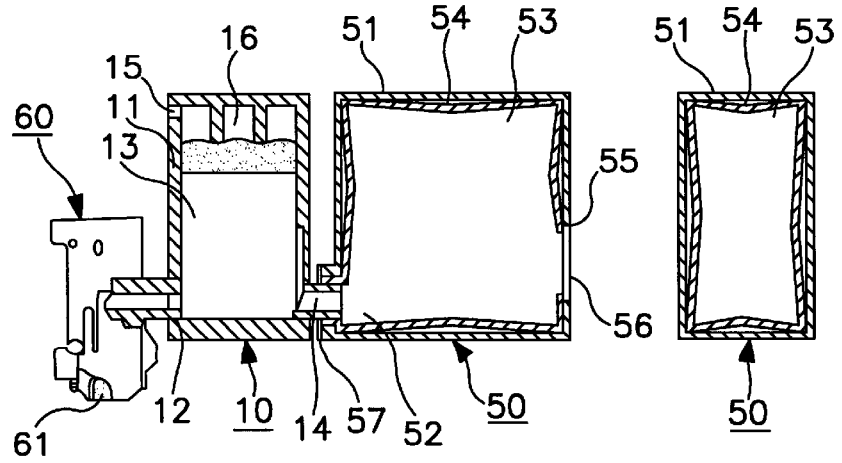

The ink accommodating chamber of the ink container may be of an exchangeable structure relative to the negative pressure producing material chamber. Referring to FIGS. 2(*a*1)–2(*c*2), the description will be made as to the states of the respective chambers when the ink accommodating chamber is connected to the negative pressure producing material chamber. FIGS. 2(*a*1)–2(*c*2) show an example of changes of each of the chambers in a connecting operation between the ink accommodating chamber and the negative pressure producing material chamber of the ink container shown in FIGS. 1(*a*)–1(*b*), suffix 1 indicates that Figure is a sectional view in the same direction as with FIG. 1, (b), and suffix 2 indicates that Figure is a sectional view (A—A) of the liquid containing chamber shown in FIG. 1(*b*).

FIGS. 2(*a*1), (*a*2) show the states of the negative pressure producing material chamber and the ink accommodating chamber before the connection therebetween. The ink discharging outlet 52 of the liquid containing chamber 50 is provided with a sealing means 57 (for example film) for preventing discharge of the ink accommodated in the ink accommodating portion, so that ink accommodating portion of the liquid containing chamber is maintained sealed against the atmosphere. The inner wall 54 constituting the ink accommodating portion is formed such that it is extended along the inner surface configuration of the casing (outer wall) 51 and that corner portion of the inner wall is close to the corner portion of the outer wall. This state is called here "initial state". The ink accommodating portion may contain an amount of the ink which is slightly smaller than the maximum capacity thereof, since then the ink is more assuredly prevented from leaking out due to the temperature change and/or pressure change, when the sealing means is unsealed. In view of the standpoint of ambient condition change, the amount of the air accommodated in the ink accommodating portion before the connection to the negative pressure producing material chamber, is desirably very small. In order to decrease the amount of air accommodated in the ink accommodating portion, a liquid injection method may be used, as disclosed in Japanese Laid-open Patent Application No. HEI-10-175311.

On the other hand, in FIG. 2(*a*1), the negative pressure producing member of the negative pressure producing material chamber retains the ink in a part thereof. In FIG. 2(*a*1), the interface of the ink accommodated in the negative pressure producing member is that in the case of it being lower than the air introducing groove, and the air introducing groove is in fluid communication with the ambience through the negative pressure producing member.

Here, the amount of the ink accommodated in the negative pressure producing member is dependent on the amount of the ink accommodated in the negative pressure producing member when the ink accommodating chamber is exchanged, which will be described hereinafter, and therefore, it may be different slightly, and it is not inevitable that ink is retained in the uniform state as shown in the Figure. The air introducing groove and the air-liquid exchange passage are not required to be filled with the liquid, and may contain the air as shown in FIG. 2(*a*1). As shown in FIG. 2(*b*1) and (*b*2), the ink accommodating chamber is connection to the negative pressure producing material chamber. At this time, the ink moves as shown by an arrow in FIG. 2(*b*1) until the pressures in the negative pressure producing material chamber and the ink accommodating chamber becomes equal to each other, and as shown in FIGS. 2(*c*1) and 2(*c*2), the balanced state is established with the pressure at the ink supply port 12 being negative. This state is called "state at start of use". The detailed disclosure will be made as to the ink movement until the balanced state is reached. As shown in FIG. 2(*b*1), when the air-liquid exchange passage 14 of the negative pressure producing material chamber is inserted into the ink discharge port of the ink accommodating chamber, the sealing means 57 is unsealed. The connecting portion is sealed by the above-described seal means at this time, so that ink does not leak through the connecting portion, or the ambience is directly introduced into the ink accommodating chamber through the connecting portion, and therefore, the ink accommodating portion is in a substantially hermetically sealed state except for the air-liquid exchange passage 14. Then, the ink in the ink accommodating portion 53 flows into the air-liquid exchange passage 14, and an ink path is established between the negative pressure producing material chamber and the negative pressure producing member 13. When the ink path is established, the ink movement rom the ink accommodating portion to the negative pressure producing member is started as shown in FIG. 2(*b*1) by the capillary force of the negative pressure producing member, by which the interface (level of liquid) of the negative pressure producing member rises. The inner wall 54 tends to deform from the central portion of the major side (maximum area side) in a direction of decrease of the volume of the ink accommodating portion 53. Here, the outer wall 51 functions to retard displacement of the corner portions of the inner wall 54, and therefore, the ink accommodating portion receives the force due to the ink consumption and rebounding force toward the initial state (FIGS. 2(*a*1) and, 2(*a*2)), so that negative pressure is generated in accordance with the degree of deformation without abrupt change. The space between the inner wall and the outer wall is in fluid communication with the ambience through the ambience communication port 55, so that air is introduced into between the inner wall 54 and the outer wall 51 in accordance with the deformation.

Even if the air is present in the air-liquid exchange passage 14 in FIG. 2(*a*1), the ink in the ink accommodating portion is contacted to the negative pressure producing member by which an ink path is formed, and therefore, the ink accommodating portion deforms with the discharge of the ink, so that air easily moves into the ink accommodating portion 53.

As regards the ink introduction into the air introducing groove, the ink is supplied thereinto when the capillary force of the air introducing groove is larger than the negative pressure generated by the ink accommodating portion, as in this embodiment. After the start of the ink movement, the ink is supplied into the negative pressure producing member, and then, as shown in FIG. 2(*c*1), the ink is filled up to above the top end portion of the ambience introduction groove, so that fluid communication of the ambience introduction groove with the ambience is shut. Then, the ink accommodating chamber receives and discharges the ink and the air only through the negative pressure producing material chamber, so that ink further moves so that negative static pressure in the air-liquid exchange passage of the ink accommodating chamber and the negative static pressure in the air-liquid exchange passage of the negative pressure producing material chamber.

In the state shown in FIG. 2(*c*1), the negative pressure in the negative pressure producing material chamber when the communication of the ambience introduction groove with the ambience is shut, is larger than the negative pressure in the ink accommodating chamber, a further ink movement occurs from the ink accommodating chamber into the negative pressure producing material chamber until the negative pressures of them becomes equal, by which the amount of the ink retained in the negative pressure producing member in the negative pressure producing material chamber increases.

As described in the foregoing, the movement of the ink from the ink accommodating chamber to the negative pressure producing material chamber when the ink accommodating chamber and the negative pressure producing material chamber are connected, is carried out without introduction of the air into the ink accommodating chamber through the negative pressure producing member. The negative static pressures in the respective chambers in the balanced state, is properly selected so that ink does not leak out of a liquid ejection recording means(unshown) such as a recording head connected to the ink supply port, depending on the nature of the liquid ejection recording means connected thereto (FIG. 6(*a*) by one skilled in the art. The lower limit of the amount of the ink which is movable from the ink accommodating portion, is the amount of the ink when the ink supply is carried out into the negative pressure producing member up to the upper limit level of the air introducing groove (air-liquid interface negative pressure producing member which will be described hereinafter), and the upper limit is the amount up to the complete ink filling into the negative pressure producing member. The amount of the ink moving to the negative pressure producing member on the basis of the amounts of the upper limit and the lower limit of the ink in consideration of the variation of the amount of the ink retained in the negative pressure producing member before the connection. By doing so, the material and the thickness of the ink accommodating portion can be properly selected for the negative pressure producing member on the basis of the negative pressure value $\alpha$ in the balanced state. Since the amount of the ink retained in the negative pressure producing member before the connection is not constant, a part of the negative pressure producing member may remain unsupplied with the ink even if the balanced state is reached as shown in FIG. 2(*c*1) and FIG. 2(*c*2). Such a part can be used as a buffer region which functions together with the buffer portion, when the temperature and/or the pressure varies, which will be described hereinafter.

On the contrary, if there is a liability that pressure of the ink supply port when the balanced state is reached, is positive due to the amount variation, the suction recovery is carried out by suction recovery means, which will be described hereinafter and which is provided in the main assembly of the liquid ejection recording device, is used to discharge a small amount of the ink.

Figure 18:
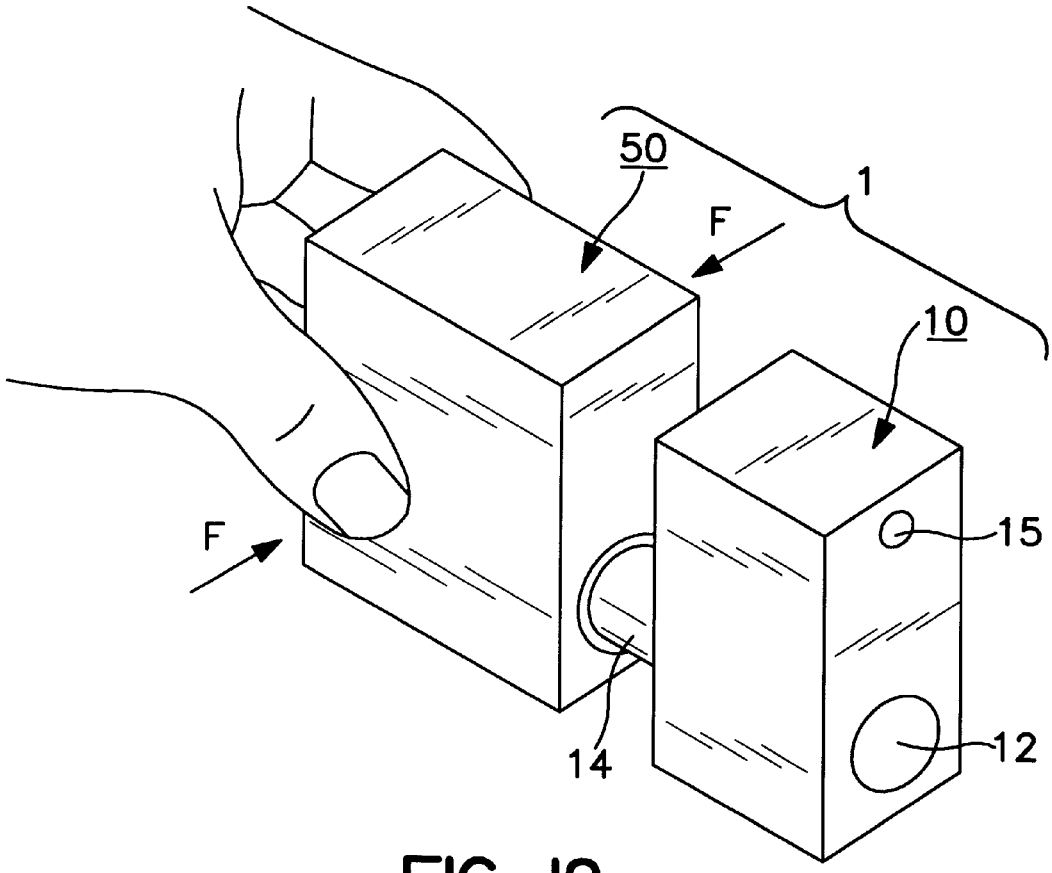
FIG. 18 is a schematic illustration of pressing the ink accommodating portion.

The establishment of the ink path in the air-liquid exchange passage upon the connecting operation, may be effected using a mechanical impact given at the time of the connecting action. For example, the ink accommodating portion is pressurized by for example pressing the casing of the ink accommodating portion, as shown in FIG. 18. Alternatively, the ink accommodating portion is placed under a slight negative pressure state, and by the ink accommodating portion being brought into fluid communication with the ambience through the air introducing groove upon the connection, the air in the air-liquid exchange passage is promoted to move into the ink accommodating portion using deformation of the ink accommodating portion by the variation of the pressure. With such use of the impact, a part of the air in the passage may move into the ink accommodating portion, depending on the configuration of the air-liquid exchange passage and/or the presence or absence of the air in the passage before the connection, but such a slight movement of the air into the ink accommodating portion is permissible.

Figure 6:
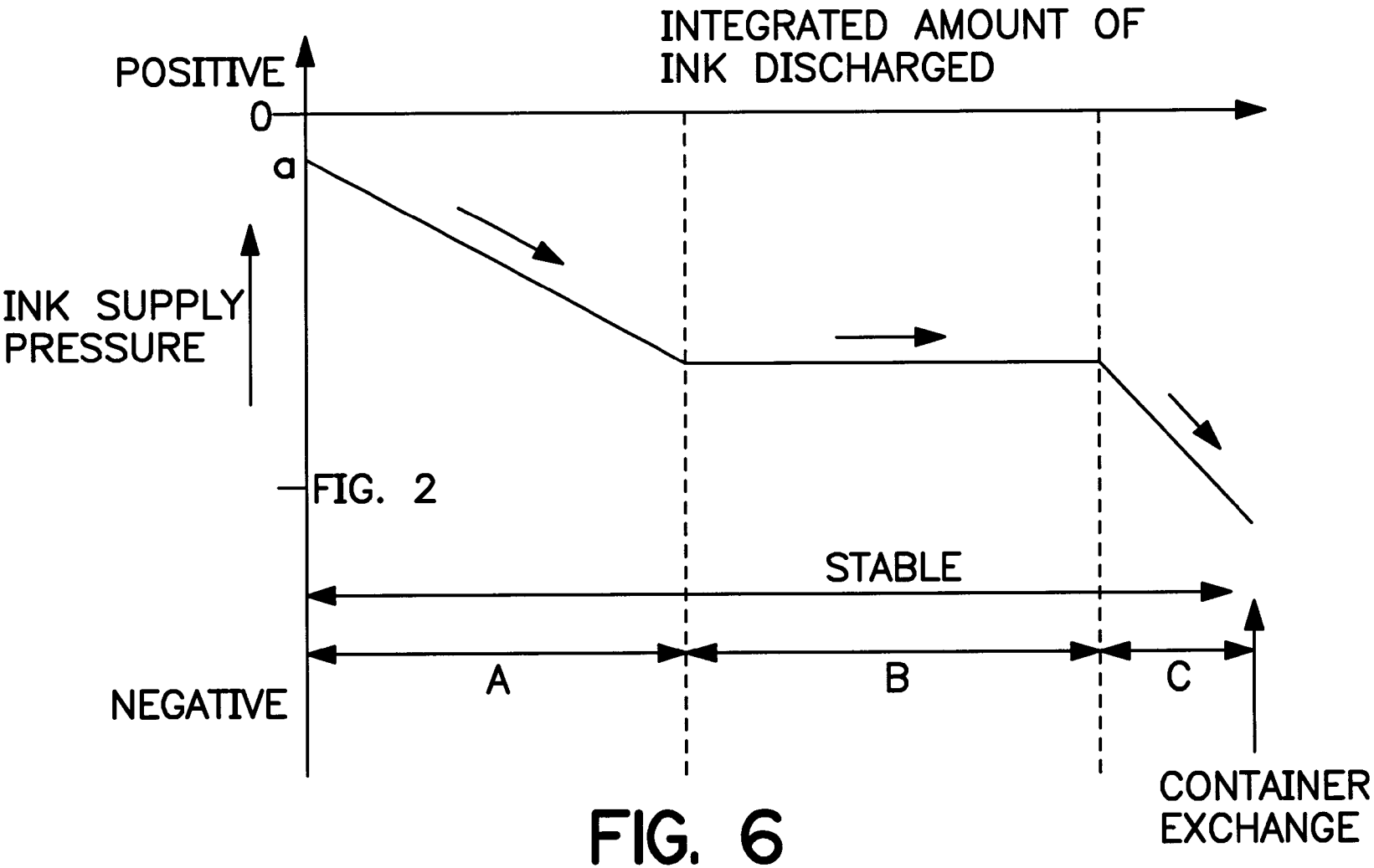
FIG. 6 is an illustration showing a relation between the amount of ink discharge and the negative static pressure at an ink supply in the ink container shown in FIGS. 1(*a*)–1(*b*).

Referring to FIGS. 3(*a*1)–6, the description will be made as to an example of states of the ink container when the liquid is consumed by the recording head connected to the ink container in the state at start of use shown in FIGS. 2(*c*1) and 2(*c*2). FIGS. 3(*a*1)–5(*c*2) show an example of the changes of the ink accommodating chamber and the negative pressure producing material chamber with the consumption of the liquid from the ink container, in the order of FIGS. 3(*a*1)–3(*c*2), FIGS. 4(*a*1)–4(*c*2) and FIGS. 5(*a*1)–5(*c*2), wherein suffix 1 indicates the sectional plane which is the same as that of FIG. 1(*b*); suffix 2 indicates the sectional plane A—A of the liquid containing chamber in FIG. 1(*b*). FIG. 6 illustrates a relation between the ink discharge amount of the ink container shown in FIGS. 1(*a*)–1(*b*) and the negative pressure of the ink supply port, wherein the abscissa represents an ink discharge amount from the ink supply port to the outside, and the ordinate is a negative pressure(negative static pressure) of the ink supply port. In FIG. 6, the change of the negative pressure shown in FIGS. 2(*a*1)–5(*c*2) are is indicated by arrow.

In this embodiment, the ink supply operation can be understood in the three modes, more particularly, before the start of air-liquid exchanging operation shown in FIGS. 3(*a*1)–3(*c*2), during (mainly) air-liquid exchanging operation shown in FIG. 4 and after air-liquid exchanging operation shown in FIGS. 5(*a*1)–5(*c*2). In the following, the respective operations are described in detail using the Figures.

(1) Before Air-liquid Exchanging Operation

In FIGS. 3(*a*1) and 3(*a*2), the ink container is mounted to the recording head. In the state at start of use, the negative static pressure in the air-liquid exchange passage of the ink accommodating chamber and the negative static pressure in the air-liquid exchange passage of the negative pressure producing material chamber are equal to each other. In the case of the ink accommodating chamber which is of a n exchangeable type as shown in FIGS. 1(*a*–1(*b*), when the ink accommodating chamber is exchanged after the ink is used up to the state shown in FIG. 2(*a*1) (the detail will be described hereinafter referring to FIG. 6), the ink accommodating portion is slightly deformed inwardly, as described hereinbefore.

When the ink consumption is started through the ink supply port 12 to the recording head 60, both of the ink contained in the ink accommodating portion and the negative pressure producing member are consumed while the balance is maintained between the increasing negative static pressures in the ink accommodating portion and the negative pressure producing member, as shown in FIGS. 3(*b*1), (*b*2). This is called "first ink supply state".

In this state, the liquid level in the negative pressure producing member in the negative pressure producing material chamber lowers with the consumption of the ink through the ink supply port, and the central portions of the ink accommodating portion stably deforms inwardly.

In the sides adjacent to the major sides (maximum area sides) in this embodiment, the portion not having the pinch-off portion starts deformation and separates from the outer wall earlier than the portion having the pinch-off portion 104, in order to reach the balance in the negative pressure between the ink accommodating portion and the negative pressure producing member. Here, the pinch-off portion 56 functions in effect as one of deformation limiting portions against the inner wall 54. Thus, opposite major sides of the ink accommodating portion deform substantially simultaneously with the discharge of the ink, so that stabilized deformation is accomplished.

This first ink supply state continues until the air is introduced to the ink accommodating portion through the air-liquid exchange passage as shown in FIGS. 3(*c*1)–3(*c*2). The negative static pressure change relative to the amount of the ink discharge through the ink supply port from the state of FIGS. 3(*a*1)–3(*a*2) to the state of FIGS. 3(*c*1)–3(*c*2), is such that it is substantially proportional to the amount of the ink discharge, and the negative static pressure gradually rises, as indicated by A in FIG. 6.

The example has been described in brief, and further detail will be described hereinafter.

(2) During Air-liquid Exchanging Operation

When the ink is further discharged, the introduction of the air into the ink accommodating portion starts as shown in FIGS. 3(*c*1)–3(*c*2). This is called "air-liquid exchange state" or "second ink supply state". In this state, as shown in FIGS. 4(*a*1)–4(*a*2) and FIGS. 4(*b*1)–4(*b*2), the liquid level of the negative pressure producing member is substantially constant(air-liquid interface) at the top end portion of the air introducing groove. With the consumption of the ink by the recording head, the air is supplied from the air vent 15 through the air introducing groove 17 and the air-liquid exchange passage 14 into the ink accommodating chamber in accordance with the consumption amount of the ink, with which the ink is supplied into the negative pressure producing member of the negative pressure producing material chamber through the air-liquid exchange passage. On the other hand, the ink accommodating portion maintains the negative pressure balance by the deformation thereof, so that air is introduced with the discharge of the ink, and maintains the configuration upon the air-liquid exchange.

Therefore, the change of the negative static pressure relative to the amount of the ink discharge through the ink supply port in the air-liquid exchange state, substantially does not occur (substantially constant negative static pressure) as indicated by B in FIG. 6, thus supplying the ink to the liquid ejection recording means with stability. However, FIG. 6 is schematic, and the negative pressure is not strictly constant in the air-liquid exchange region. In the ink container of the present invention, the ink accommodating chamber per se can be contributable to the generation of the negative pressure by the deformation of the ink accommodating portion. When the ink is discharged continuously in the air-liquid exchange state, a time difference may frequently occur between the discharge of the liquid from the ink accommodating portion and the introduction of the air through the air-liquid exchange path, as will be described hereinafter. The time difference can be a cause of the negative pressure variation, which however is tolerable in the case of the ink jet recording apparatus.

When the air-liquid exchange path has a degree of length as in this embodiment, the bubble of the air-liquid exchange stagnates in the air-liquid exchange path, and the bubble moves into the ink accommodating portion when the amount thereof reaches a certain level, depending on the kind of the ink. This is also a cause of the negative pressure variation upon the movement of the bubble, but the variation is tolerable when the liquid container is used with an ink jet recording apparatus. This is also the air-liquid exchange state.

When the bubbles tend to stagnate in the air-liquid exchange path, the air-liquid exchange path may be temporarily kept plugged by the bubble even it the ink level in the ink accommodating portion lowers beyond the top end portion of the air-liquid exchange path as shown in FIGS. 4(*c*1)–4(*c*2). In this state, if, for example, the bubble despairs, and the ink accommodating portion becomes temporarily in complete fluid communication with the ambience, the ink accommodating portion deforms more toward the initial state than in the air-liquid exchange state shown in FIGS. 4(*b*1) and 4(*b*2). But, when it is plugged by the bubble, the ink is moved from the ink accommodating portion into the negative pressure producing material chamber in place of feeding of a new bubble into the air-liquid exchange path, as if the air-liquid exchange state were carried out. Therefore, the state of FIGS. 4(*c*1) and 4(*c*2) is included in the air-liquid exchange state in the present invention if the negative pressure in the ink container is substantially within a range of the negative pressure of the other part of FIGS. 4(*a*1)–4(*c*2).

In the foregoing, the air-liquid exchanging operation of the ink container has been described, but in the case of the deformable ink accommodating chamber as in this invention, the operation during the air-liquid exchange is not limited to the above.

In the conventional non-deformable ink accommodating chamber, the ink is supplied into the negative pressure producing member immediately with the introduction of the ambience into the ink accommodating chamber. When the ink accommodating chamber is deformable, the ink may be supplied into the negative pressure producing member without the introduction of the ambience into the ink accommodating chamber. On the contrary, the ink may not be supplied into the negative pressure producing member immediately after the introduction of the ambience into the ink accommodating chamber with the consumption of the ink. This depend on the negative pressure balance between the displacement of the ink accommodating chamber and the negative pressure producing material chamber. Further detailed description will be made as to this, hereinafter, but it should be noted that timing of the air-liquid exchanging operation may be different from that in the conventional ink container, and by the time difference between the ink discharge from the ink accommodating portion and the introduction of the air into the ink accommodating portion upon the air-liquid exchange, the stable ink supply is more reliable because of the buffer effect and the timing deviation even upon external factors such as abrupt ink consumption, ambient condition change, vibration.

(3) After Air-liquid Exchanging Operation

When the ink is further discharged through the ink supply port, the ink level in the ink accommodating portion becomes lower than the upper end of the air introducing groove, so that ink accommodating portion becomes in complete fluid communication with the air-liquid exchange path, as shown in FIGS. 5(*a*1) and 5(*a*2). At this time, the ink accommodating portion deforms more toward the initial state than in the air-liquid exchange state by the communication with the ambience. However, even if the inside pressure becomes the ambient pressure, the configuration does not completely restores, and it is in a slightly deformed state. In this embodiment, the air-liquid exchange path has a large diameter, and therefore, a small amount of the ink remaining in the ink accommodating portion is absorbed by the negative pressure producing member with the result of rising of the liquid level in the negative pressure producing member, so that negative pressure temporarily lowers. Thereafter, the air-liquid exchange path is sealed by the ink in the negative pressure producing material, the ink is consumed similarly to the air-liquid exchanging operation described hereinbefore.

When the liquid level in the negative pressure producing member slightly lowers beyond the top end of the air introducing groove, the pressure in the ink accommodating chamber is described as becoming the atmospheric pressure immediately, but this is an example of the action in the embodiment of the present invention. Further detailed description will be made hereinafter.

When the ink is substantially completely consumed from the ink accommodating portion, the ink remaining in the negative pressure producing material chamber is consumed as shown in FIGS. 5(*c*1) and 5(*c*2). Normally, when the ink container is placed on a carriage, the ink in the ink accommodating chamber is completely absorbed in the negative pressure producing member due to the vibration during the carriage scanning. But, it is preferable that ink accommodating chamber is inclinedly mounted such that supply port takes a lower position with respect to the direction of gravity. The change of the negative pressure relative to the amount of the ink discharge through the ink supply port in the state after the air-liquid exchanging operation, is such that negative pressure increases in proportion to the amount of the ink discharge, as indicated by C in FIG. 6. After this state is reached, even if the ink accommodating chamber is demounted, the ink leakage is not liable through the air-liquid exchange passage 14 or the ink discharging outlet 52, and therefore, the ink accommodating chamber is demounted, and a new ink accommodating chamber is prepared as shown in FIGS. 2(*a*1) and 2(*a*2). Even when the ink is further consumed beyond the state shown in FIGS. 5(*c*1) and 5(*c*2) so that negative pressure producing member adjacent the air-liquid exchange path does not retain the ink, the negative pressure producing member adjacent the air-liquid exchange path which is an ink supply path can be filled with the ink with certainty, since when the ink path is established by the exchanging operation described in the foregoing, the ink accommodating portion deforms with the discharge of the ink.

In the foregoing, the liquid supplying operation of the ink container in this embodiment (FIGS. 1(*a*)–1(*b*)) has been described.

Thus, in the example of the ink consuming operation, when the ink accommodating chamber is connected with the negative pressure producing material chamber, the ink moves until the pressures of negative pressure producing material chamber and the ink accommodating chamber becomes equal so that state at start of use is established. When the ink consumption by the liquid ejection recording means is started thereafter, the ink is consumed both from the ink accommodating portion and the negative pressure producing member while the rising negative static pressures are balanced therebetween. Thereafter, the air-liquid exchange state occurs wherein the ink is discharged with a substantially constant negative pressure while the air-liquid interface of the negative pressure producing member is maintained by the introduction of the air into the ink accommodating portion, and finally, the ink remaining in the negative pressure producing material chamber is consumed.

Thus, there is a step in which the ink is used from the ink accommodating portion without the introduction of the ambience into the ink accommodating portion, so that limitation to the inside volume of the liquid accommodating container in the ink supply process (first ink supply state) is only by the air introduced into the ink accommodating portion in the connection. As a result, the limitation to the inside volume of the ink accommodating chamber can be reduced without influence to the accommodation of the ambient condition change.

In the structure of the present invention, the air-liquid exchanging operation can be effected at different timing from that in the air-liquid exchange of the prior art, the ink supply is possible in other than normal state.

According to the present invention, the ink can be substantially completely consumed from the ink accommodating chamber, and in addition, the air-liquid exchange passage may contain the air when the ink container is exchanged, and the ink accommodating chamber can be exchanged irrespective of the amount of the ink retained in the negative pressure producing member. Therefore, the ink accommodating chamber is easily exchangeable without use of the remaining amount detecting mechanism.

As shown in FIG. 6, in order that negative pressure rises in proportion to the amount of the ink discharge (A), and thereafter, it is substantially constant (B), and then, the negative pressure rises in proportion to the ink discharge amount (C), it is desirable that ambience introduction occurs, that is, the state shifts from A to B before opposing parallel sides of the ink accommodating portion are brought into contact. This is because the ratio of the negative pressure change relative to the amount of the ink discharge in the ink accommodating chamber is different between before and after the opposing maximum area sides are contacted.

Figure 7A:
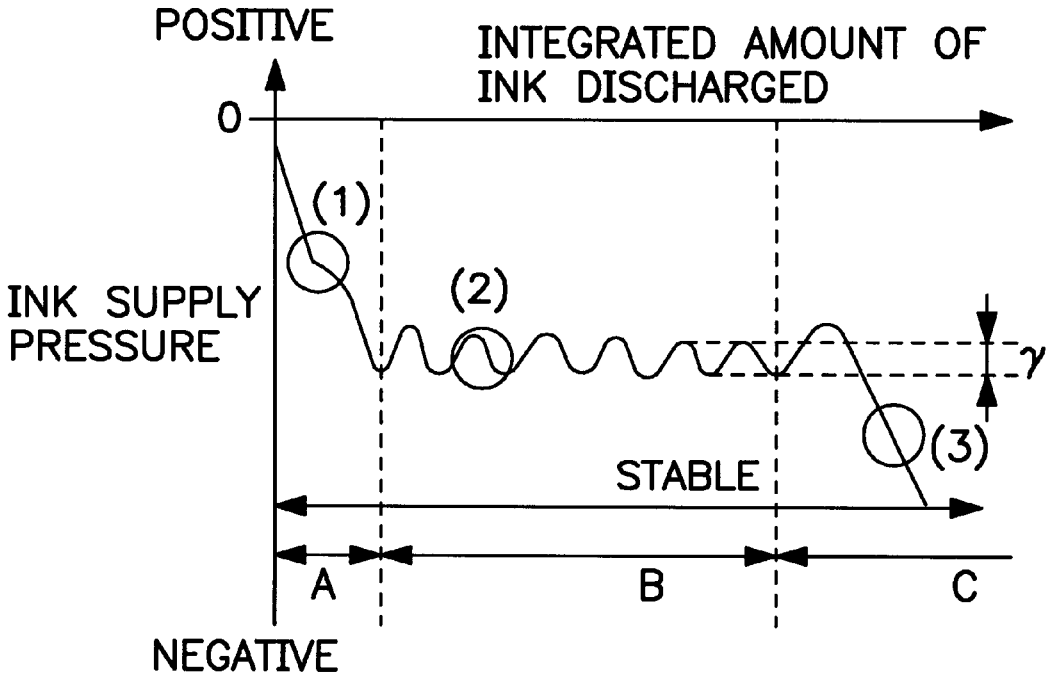
FIGS. 7(*a*) and 7(*b*), FIG. 7(*a*) is a detailed illustration of a negative pressure curve shown in FIG. 6.
Figure 7B:
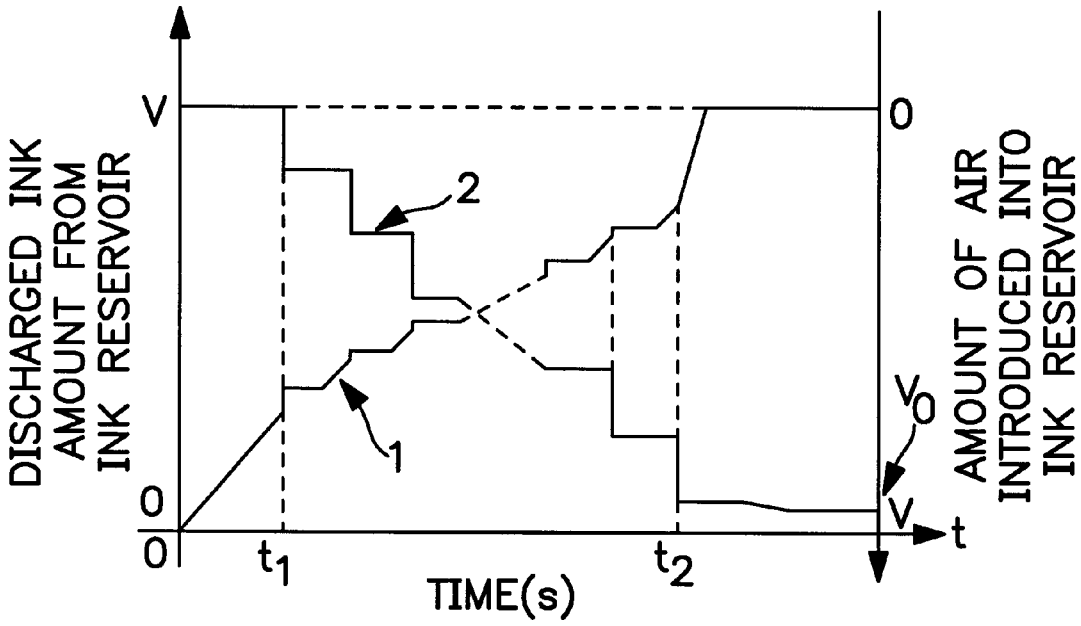

With respect to the first embodiment, the ink supply performance of the ink container has be checked. A negative pressure producing member having a pore size of approx 60/inch is placed in the negative pressure producing material chamber having inner dimensions of 48 mm×46 mm×10 mm approx, and the air-liquid exchange path is in the form of a hollow pipe having an inner diameter of approx 7 mm. The negative pressure producing material chamber is connected to an ink accommodating chamber including an outer wall of shock resistant polystyrene (HIPS) resin material having a maximum thickness of approx 1 mm and an inner wall of high density polyethylene (HDPE) resin material having a maximum thickness of approx 150 $\mu$m and having a volume approx 30 $cm^3$. Then, the ink is sucked out through the ink supply port of the negative pressure producing material chamber. It has been confirmed that ink is consumed with the negative pressure property similar to the those shown in FIG. 6. The negative static pressure during the ink stabilized supply period (B in FIG. 6) was approx—110 mmAq. The change of the negative static pressure relative to the amount of the ink discharge was as shown in FIGS. 7(*a*)–7(*b*). By changing the material, thickness of the inner wall of the ink accommodating portion and/or the capillary force generated by the negative pressure producing member, the following has been found.

Figure 8:
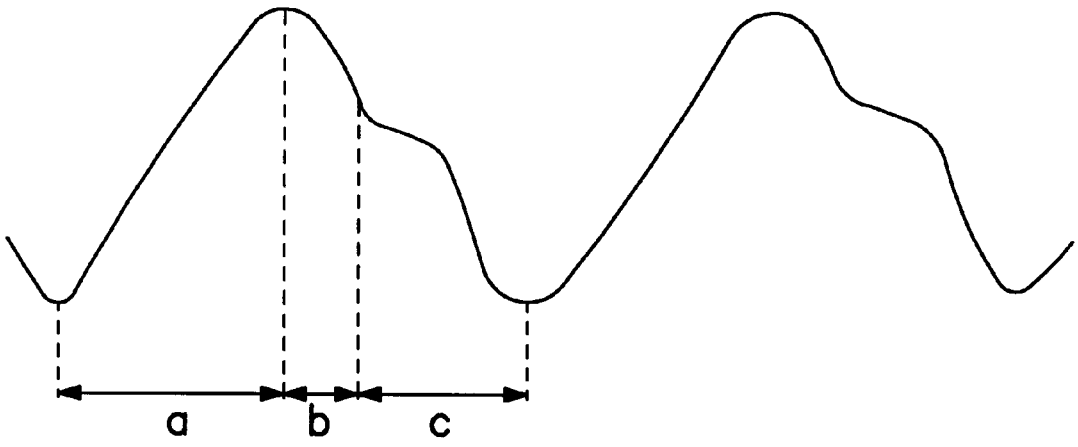
FIG. 8 is a detail illustration of an A region shown in FIGS. 7(*a*)–7(*b*).
Figure 9:
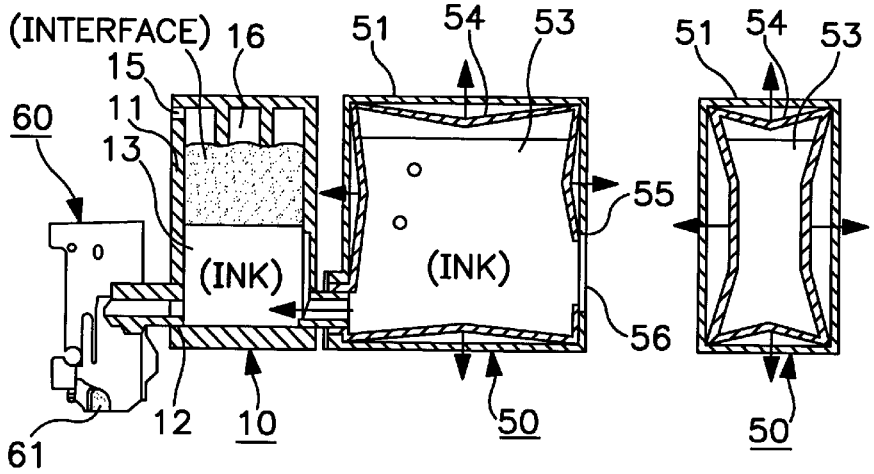
FIGS. 9(*a*1)–9(*c*2) are illustrations of operation of an ink container as regards the A region shown in FIGS. 7(*a*)–7(*b*).
Figure 9:
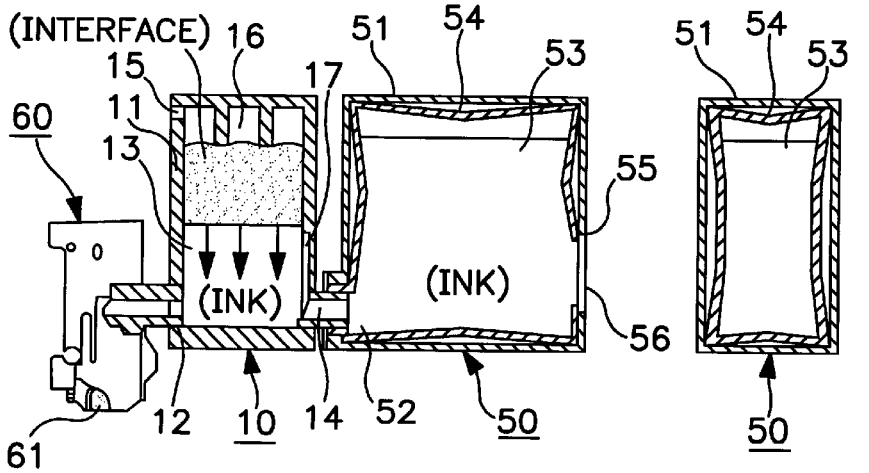
Figure 9:
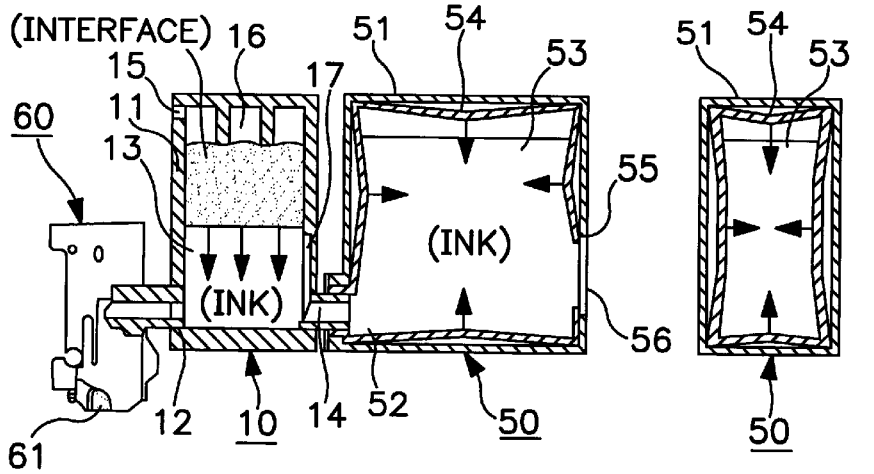
Figure 10:
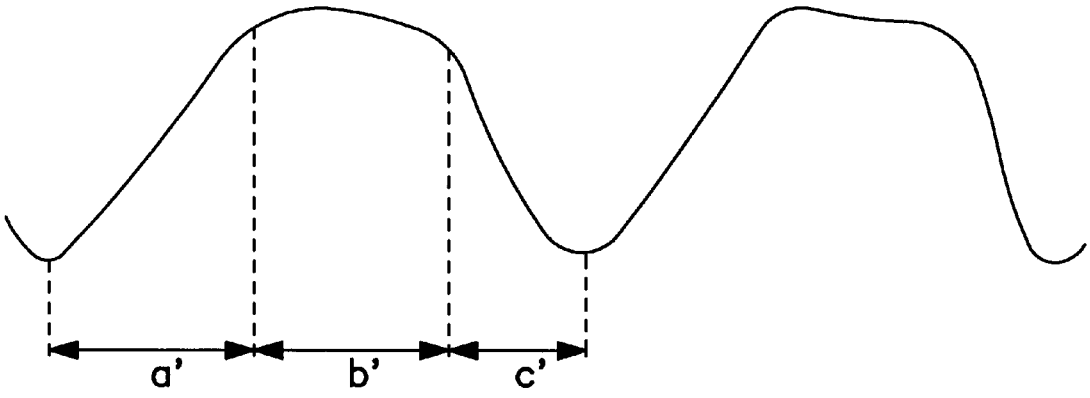
FIG. 10 is a detail illustration as to B region shown in FIGS. 7(*a*)–7(*b*).

FIGS. 7(*a*)–7(*b*) shows details of an actual example of the negative pressure curve of FIG. 6, and (1), (2), (3) in the Figure corresponds to the (1), (2), (3) in the foregoing disclosure of the operations. FIG. 8 shows a detail of an example of A region in FIGS. 7(*a*)–7(*b*); FIGS. 9(*a*1)–9(*c*2), illustrate the operation of the ink container in the A region in FIGS. 7(*a*)–7(*b*) in the order of (*a*)–(*c*); FIG. 10 shows an example of B region in FIGS. 7(*a*)–7(*b*); FIG. 11(*a*1)–11(*c*2) show the operation of the ink container in the B region in FIGS. 7(*a*)–7(*b*) in the order of (*a*)–(*c*). In FIGS. 9(*a*1)–9(*c*2) and 11(*a*1)–11(*a*2), suffix 1 indicates a sectional view along the same line as with FIG. 1(*b*), and suffix 2 indicates a sectional view taken along a line A—A of the liquid containing chamber in FIG. 1(*b*). For better understanding, the deformation or the like of the ink accommodating chamber is more or less exaggerated.

(1) Region (1) in (1)

This region (before air-liquid exchanging operation) is disclosed in the following three patterns. The patterns are within the present invention, and are dependent on the capillary force of the negative pressure producing member, the thickness, material or the like of the ink accommodating chamber portion and the balance.

(First Pattern in Region (1) in FIGS. 7(*a*)–7(*b*))

This pattern occurs generally when the ink accommodating chamber rather than the negative pressure producing member is ruling in the negative pressure control. More particularly, when the thickness of the ink accommodating chamber portion is relatively thick, or when the rigidity of the inner wall of the ink accommodating chamber portion is relatively high, this pattern tends to occur.

In the ink discharge from the initial state, the ink is discharged from the negative pressure producing member.

This is because the resisting force against the discharge of the ink from the negative pressure producing member is smaller than the resisting force against the discharge of the ink from the ink accommodating chamber. After the ink is first discharged from the negative pressure producing member, the ink is discharged from the respective chambers while balance is maintained therebetween. When the ink Is discharged from the ink accommodating chamber, the inner wall is deformed inwardly.

(Second Pattern in Region (1) in FIGS. 7(*a*)–7(*b*))

This pattern tends to occur when the negative pressure producing member rather than the ink accommodating chamber is ruling in the negative pressure control, contrary to the case of the first pattern. More particularly, this case tends to occur when the inner wall of the ink accommodating chamber is relatively thin, or when the rigidity of the inner wall is small.

In the discharge of the ink in the initial state, the ink is first discharged from the ink accommodating chamber. This is because the resisting force against the discharge of the ink from the ink accommodating chamber is smaller than the resisting force against the discharge of the ink from the negative pressure producing member. Thereafter, the ink is discharged from the negative pressure producing member and the ink accommodating chamber while balance is maintained therebetween.

(Third Pattern in Region (1) in FIGS. 7(*a*)–7(*b*))

In this pattern tends to occur when the negative pressure producing member and the ink accommodating chamber portion are similarly ruling with respect to the negative pressure control. In this case, in the ink discharge in the initial state, the ink is discharged from the negative pressure producing member and the ink accommodating chamber while balance is maintained therebetween. With the balance maintained, the air-liquid exchange state which will be described hereinafter starts.

(2) Region (2) in FIGS. 7(*a*)–7(*b*)

The description will be made as to air-liquid exchanging operation region. This region is divided into two patterns. For the purpose of detailed description, the negative pressure curve in the region (2) in FIGS. 7(*a*)–7(*b*) is enlarged.

(First Pattern of Region (2) in FIGS. 7(*a*)–7(*b*))

This pattern occurs generally when the ink accommodating chamber rather than the negative pressure producing member is ruling in the negative pressure control. More particularly, when the thickness of the ink accommodating chamber portion is relatively thick, or when the rigidity of the inner wall of the ink accommodating chamber portion is relatively high, this pattern tends to occur.

In the air-liquid exchanging operation region, the ambience is introduced from the negative pressure producing material chamber into the ink accommodating chamber (FIG. 8*a* region), This is to balance the negative pressures. By the introduction of the ink into the ink accommodating chamber, the inner wall of the ink accommodating chamber slightly deforms outwardly, as shown in FIGS. 9(*a*1)–9(*a*2). By the introduction of the air, the ink is supplied into the negative pressure producing material chamber from the ink accommodating chamber, so that liquid level in the negative pressure producing material chamber slightly rises. (FIGS. 9(*a*1)–9(*b*2).

By the further discharge of the ink from the head, the ink is first discharged from the negative pressure producing member in this example. By this, the liquid level in the negative pressure producing material chamber lowers as shown in the Figure (FIG. 8*b* region) and ((FIG. 9*b*).

After this state, the ink becomes discharged from both of the negative pressure producing member and the ink accommodating chamber while the balance is maintained therebetween. By this, the liquid level in the negative pressure producing member lowers further, and the inner wall of the ink accommodating chamber deforms inwardly (FIG. 8 region c) and (FIGS. 9(*c*1)–9(*c*2).

After continuance of this state, the ambience is introduced into the ink accommodating chamber through the ambience introduction path, and FIGS. 7(*a*)–7(*b*) region occurs.

(Second Pattern in Region (2) FIGS. 7(*a*)–7(*b*))

This pattern tends to occur when the negative pressure producing member rather than the ink accommodating chamber is ruling in the negative pressure control, contrary to the case of the first pattern. More particularly, this case tends to occur when the inner wall of the ink accommodating chamber is relatively thin, or when the rigidity of the inner wall is small.

As described in hereinbefore, the ambience is introduced into the ink accommodating chamber from the negative pressure producing material chamber in the air-liquid exchanging operation region (region a in FIG. 10). By the introduction of the ink into the ink accommodating chamber, the inner wall of the ink accommodating chamber slightly deforms outwardly, as shown in FIGS. 11(*a*1)–11(*a*2). By the introduction of the air, the ink is supplied into the negative pressure producing material chamber from the ink accommodating chamber, so that liquid level in the negative pressure producing material chamber slightly rises. (FIGS. 10(*a*1)–10(*b*2).

By the further ink discharge from the head, the ink is mainly discharged from the ink accommodating chamber in this pattern. In this case, the negative pressure does not change greatly and therefore gradually increases because of the thickness and the rigidity of the ink accommodating chamber. By the discharge of the ink, the inner wall of the ink accommodating chamber gradually deforms inwardly (region b in FIG. 10). In this region, the ink is hardly discharged from the negative pressure producing member, and therefore, the liquid level of the negative pressure producing member hardly changes.

In region b, when the ink is further discharged, the ink is discharged from both of the negative pressure producing member and the ink accommodating chamber while the balance is maintained therebetween (region c of FIG. 10). In this region, as described in the foregoing, the liquid level of the negative pressure producing member lowers, and the inner wall of the ink accommodating chamber deforms inwardly (region c of FIG. 10) and (FIGS. 11(*c*1)–11*c*2)). After this state continues, the ambience is introduced into the ink accommodating chamber through the ambience introduction path, so that state of FIG. 10 occurs region (3) in FIGS. 7(*a*)–7(*b*).

Finally, region (3) in FIGS. 7(*a*)–7(*b*) after the air-liquid exchange region will be described. After the air-liquid exchange ends, that is, most of the ink in the ink accommodating chamber is discharged, the ink is discharged only from the negative pressure producing member. This region is divided into the following two patterns:

(First Pattern of Region (3) in FIGS. 7(*a*)–7(*b*))

In this example, the description will be made as to the case where the pressure in the ink accommodating chamber becomes substantially the ambient pressure after the air-liquid exchange region.

After the end of the air-liquid exchange, the ink in the ink accommodating chamber is hardly discharged. In the state after the end of the air-liquid exchange, a meniscus is generally formed in the air vent path, the fluid communication path between the negative pressure producing material chamber and the ink accommodating chamber or in the negative pressure producing member. However, when the liquid level in the negative pressure producing member lowers beyond the top end portion of the ambience introduction path, the meniscus is broken by the carriage vibration or the like. By this, the ink accommodating chamber is brought into a fluid communication with the ambience through the air vent path. Thus, the pressure in the ink accommodating chamber becomes substantially ambient pressure. Then, the inner wall of the ink accommodating chamber having been deformed inwardly tends to restore by the elasticity of itself. However, generally, it does not return completely to the initial state. This is because, yielding occurs when the inner wall deforms inwardly beyond a certain degree by the discharge of the ink from the ink accommodating chamber, in may cases. Then, the ink accommodating chamber does not completely restore even if the pressure therein becomes ambient pressure.

Thus, after the pressure of the ink accommodating chamber becomes the atmospheric pressure, and the inner wall restores, the liquid level in the negative pressure producing member lowers by the discharge of the ink in the negative pressure producing member. Thus, the negative pressure increases substantially proportionally.

(Second Pattern in Region (3) in FIGS. 7(*a*)–7(*b*))

In this pattern, even if the liquid level in the negative pressure producing member lowers beyond the top end portion of the ambience introduction path, the ink accommodating chamber maintains the negative pressure state. As described hereinbefore, the inside of the ink accommodating chamber is isolated from the ambience by the meniscus in the ambience introduction path, the fluid communication path and/or the negative pressure producing member. With this state maintained, the ink is consumed, and the liquid level in the negative pressure producing member continues to lower, as the case may be. By this, the ink is consumed from the negative pressure producing member, while the inner wall of the ink accommodating chamber is kept deformed inwardly.

However, the meniscus may be broken by the carriage vibration, ambient condition change or another cause during the ink consumption, by which the pressure in the ink accommodating chamber becomes atmospheric. If this occurs, the inner wall of the ink accommodating chamber restores substantially the initial configuration. As described in the foregoing, in the air-liquid exchanging operation in the structure of this invention, the pressure variation (amplitude $\gamma$ and period) during the air-liquid exchange is relatively larger than a conventional ink container system using air-liquid exchange.

The reason for this is that inner wall of the ink accommodating chamber is deformed inwardly by the ink discharge before the air-liquid exchange, as described with region (1) of FIGS. 7(*a*)–7(*b*). Therefore, the inner wall of the ink accommodating chamber is always biased toward outside by the elastic force. Therefore, during the air-liquid exchange, the amount of the air introduced into the ink accommodating chamber may be larger in many cases than a predetermined level in order to ease the pressure difference between the negative pressure producing member and the ink accommodating chamber portion. By this, the amount of the ink discharged into the negative pressure producing material chamber from the ink accommodating chamber tends to be larger. In the conventional system wherein the ink reservoir (ink accommodating chamber) does not deform, the ink is discharged into the negative pressure producing material chamber immediately upon introduction of a predetermined amount of the air.

In a solid image mode printing operation, for example, a large amount of the ink is ejected. In response, the ink is abruptly discharged from the container. Even if this occurs, according to the present invention, the ink supply does not stop because of the above-described larger amount of ink discharge In the air-liquid exchange. In the present invention, the ink is discharged while the ink accommodating chamber is deformed inwardly, a buffering effect is significant against external factors such as vibration thereof due to the carriage movement or ambient condition change.

Referring to FIG. 7(*b*), further description will be made as to the operation during the ink consumption, from another standpoint.

In the example of FIG. 7(*b*), the abscissa represents time, and the ordinate represents an amount of ink discharge from the ink accommodating portion and an amount of air introduced into the ink accommodating portion. The amount of ink supply to the ink jet head is constant, here.

The solid line (1) is the amount of the ink discharge from the ink accommodating portion, and the ink accommodating portion is the amount of air introduction into the ink accommodating portion.

From t=0 to t=t1, the air-liquid exchange is not yet started (FIG. 7(*a*)). In this region, the ink is discharged from the head from the negative pressure producing member and the ink accommodating portion, while the pressure balance is maintained between them. The discharge patterns are as described above.

The duration from t=t1 to t=t2 corresponds to the air-liquid exchange region (B region) of FIG. 7(*a*). In this region, the air-liquid exchange occurs on the basis of the negative pressure balance as described above. As indicated by the solid line (1) in FIG. 7(*b*), the ink is discharged from the ink accommodating portion in accordance with the introduction of the air into the ink accommodating portion (stepped portion of the solid line (2)). At this time, the fact is not that amount of the ink which is equal to the amount of the air introduced into the ink accommodating portion, is immediately discharged from the ink accommodating portion. But, a predetermined Period after the introduction of the air, the amount of the ink which is equal to the final total amount of the air is discharged. As will be understood from the Figure, there is timing deviation as contrasted to the operation of the conventional ink container in which the ink accommodating portion does not deform. The operation is repeated in the air-liquid exchange region. At a certain point of time, the amount of the air in the ink accommodating portion and the amount of the ink therein is reversed. After t=t2, the action enters the region (c region), that is, the region after the air-liquid exchange, as shown in FIG. 7(*a*). In this region, the pressure in the ink accommodating portion becomes substantially equal to the ambient pressure. (however, the ambient pressure state is not reached depending ton the situation, as described in the foregoing) the inner wall of the ink accommodating portion restores the initial position by the elastic force. But, by the so-called yielding, it does not restore to the completely initial state. Therefore, the final air introduction amount Vc into the ink accommodating portion is smaller than the initial volume (V>Vc). In the region, the ink in the ink accommodating portion is used up. Referring to FIGS. 12(*a*)–12(*b*), the description will b e made as to the case wherein the ink accommodating chamber portion is exchanged in each of the regions of the ink consumption.

Figure 12A:
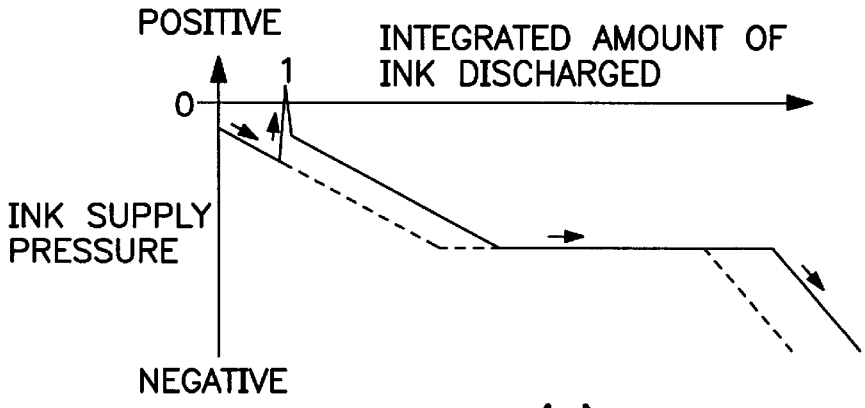
FIGS. 12(*a*)–12(*c*) illustrate operation during exchange of the ink accommodating chamber.

(a) Exchange of Ink Container Before Air-liquid Exchange (FIG. 12*a*)

Before the start of the air-liquid exchange, the pressures are balanced between the negative pressure producing member and the ink accommodating chamber, while the ink is consumed. In this state, the negative pressure itself is increasing substantially in proportion to the consumption. The ink level in the negative pressure producing member is above the top end of the ambience introduction path. When the ink accommodating chamber is exchanged in this state, the negative pressure in the ink accommodating chamber is low i n the initial stage, even to the extent that pressure is positive in some cases. Therefore, if a fresh ink accommodating chamber is mounted, the ink is supplied from the ink accmmodating chamber into the negative pressure producing member with the result that liquid level in the negative pressure producing material chamber rises, and the rising stops when the balance is reached therebetween. In this case, the upper portion of the negative pressure producing member functions as a buffer region, so that even if the liquid level rises, the ink does not leak through the air vent. By the mounting of the ink accommodating chamber, the negative pressure decreases even to the extent to positive, as the case may be, but the proper negative pressure is provided by initial recovery after the container mounting. Thereafter, the ink is consumed with the consumption pattern described in the forgoing.

With the liquid supply system of the present invention, even if the negative pressure producing member is not filled with the ink adjacent the air-liquid exchange path of the negative pressure producing material chamber, the ink in the ink accommodating portion can be moved into the negative pressure producing member, if an ink path is formed from the ink accommodating portion to the negative pressure producing material chamber, by the capillary force of the negative pressure producing material chamber. Therefore, the ink in the ink accommodating chamber can be assuredly used when it is mounted, irrespective of the retaining state of the ink in the negative pressure producing member adjacent the connecting portion.

Figure 12B:
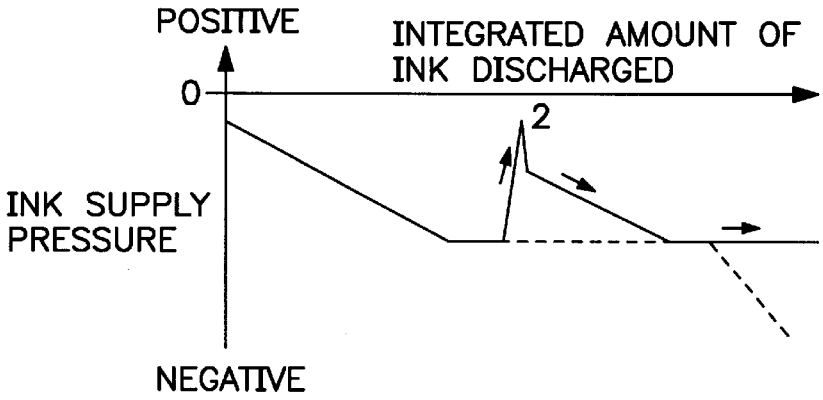

(b) Exchange of Ink Container During Air-liquid Exchange (FIG. 12*b*)

In the air-liquid exchanging operation, the liquid level of the negative pressure producing member is generally stably at the top end portion of the ambience introduction path, and the inner wall of the ink accommodating chamber is kept deformed.

When the ink accommodating chamber is demounted in this state, and a fresh ink accommodating chamber is mounted, the ink is supplied from the ink accommodating chamber into the negative pressure producing member with the result that liquid level in the negative pressure producing member rises. More particularly, the liquid level rises beyond the ambience introduction path. By this, the inner wall of the ink accommodating chamber displaces inwardly, and the container is brought into a slightly negative pressure state.

When the ink is consumed after the liquid level is stabilized, the ink is consumed in accordance with the consumption pattern ((1)–1–(1)–3). When the predetermined negative pressure is reached the air-liquid exchange occurs.

Figure 12C:
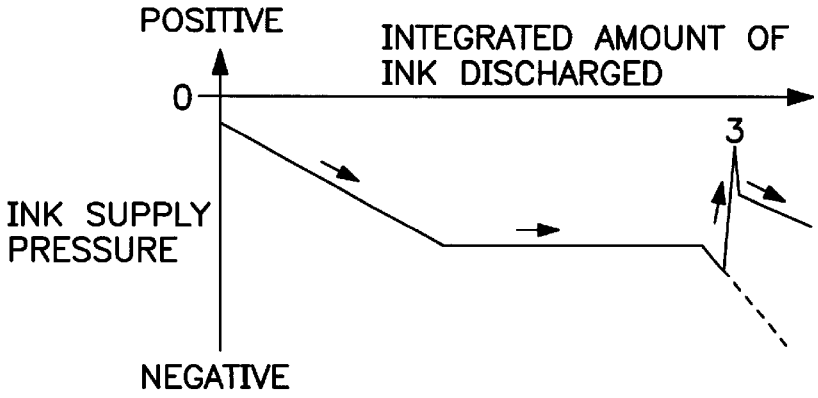

(c) Exchange of Ink Container After Air-liquid Exchange (FIG. 12*c*)

After the end of the air-liquid exchange, the liquid level of the negative pressure producing member is lower than the top end of the ambience introduction path, and the pressure in the ink accommodating chamber is atmospheric with the inner wall takes substantially the initial position, or the pressure therein is negative with the inner wall being kept deformed. When the ink accommodating chamber is exchanged with this state, the ink in the ink accommodating chamber is supplied into the negative pressure producing member, and the liquid level in the negative pressure producing member rises. Generally, it rises beyond the top end of the ambience introduction path, but balance may be reached when the liquid level is below the top end. By the ink discharge, the inner wall of the ink accommodating chamber deforms inwardly, and the pressure therein becomes substantially negative.

When the liquid level rises beyond the ambience introduction path, the operation enters the air-liquid exchanging operation region after the above-described consumption process. When balance is reached while the liquid level is below the top end of the ambience introduction path, the air-liquid exchanging operation starts immediately.

As described in the foregoing, the stable negative pressure can be provided even when the ink accommodating chamber is exchanged in any of the consumption process (a)–(c), so that assured ink supply operation is possible.

Figure 13:
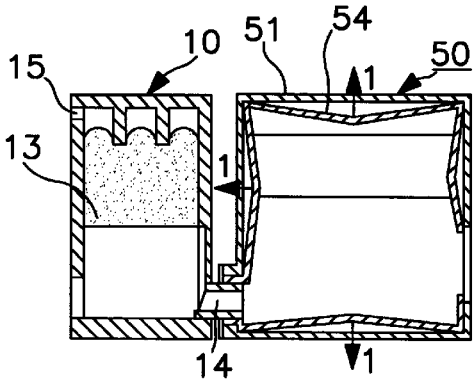
FIGS. 13(*a*1)–13(*d*2) are illustrations of a mechanism of stabilized liquid retention when an ambient condition is changed in the ink container shown in FIGS. 1(*a*) and 1(*b*).
Figure 13:
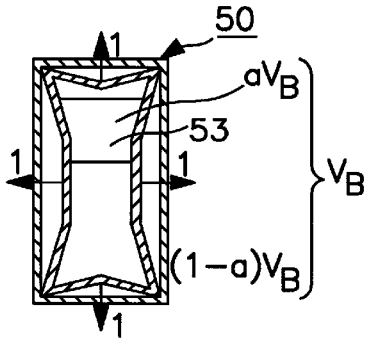
Figure 13:
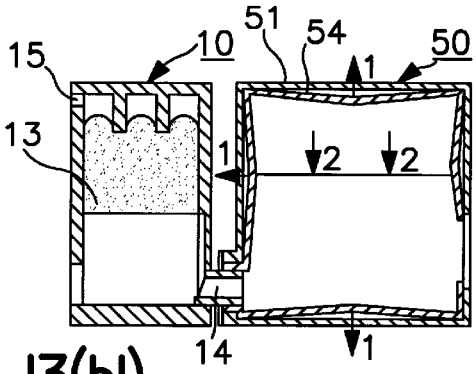
Figure 13:
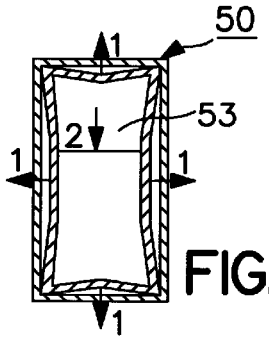
Figure 13:
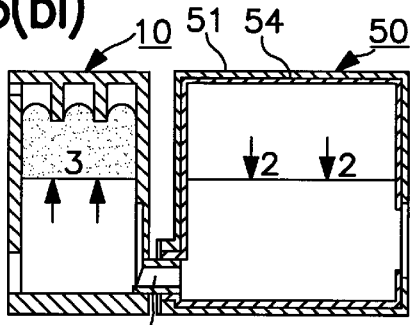
Figure 13:
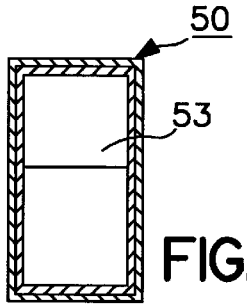
Figure 13:
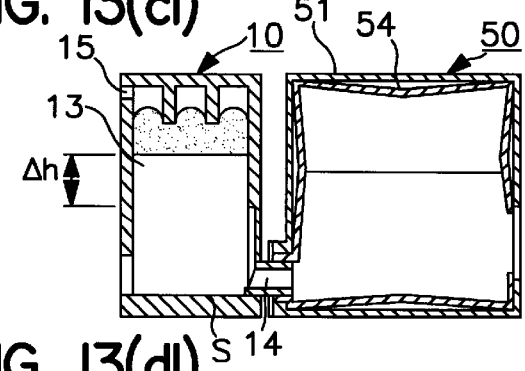
Figure 13:
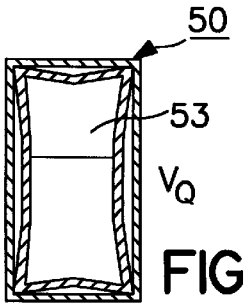

According to the ink container of the present invention, a small negative pressure variation can be accommodated by the ink accommodating portion, and in addition, even if the ink accommodating portion contains the air as in the second ink supply state, it can accommodate the change of the ambience differently from the conventional method. Referring to FIGS. 13(*a*1)–13(*d*2) and 14(*a*)–14(*b*), the description will be made as to a mechanism of stabilized liquid retaining when the ambient condition is changed with respect to the ink container of FIGS. 1(*a*)–1(*b*). FIGS. 13(*a*1)–13(*d*2) illustrates a function, as a buffering absorbing material, of a portion of the negative pressure producing member which is above the air introducing groove, and a buffer function of the ink accommodating portion, and shows changes of the ink container from the state (air-liquid exchange state) shown in FIGS. 4(*a*1)–4(*a*2), when the air in the ink accommodating chamber is expanded due to the rise of the ambient temperature or the reduction of the atmospheric pressure. In this Figure, suffix 1 indicates that it is a sectional view taken along the similar plane as in FIG. 1, (b); and suffix 2 indicates that it is a sectional view taken along a line A—A of the liquid containing chamber shown in FIG. 1(*b*). Upon pressure reduction of the ambient pressure (or rising of the ambient temperature), the air in the ink accommodating chamber expands. As shown in FIGS. 13(*b*1), (*b*2), the wall surface(1) constituting the ink accommodating portion and the liquid level(2) are pressed so that inside volume of the ink accommodating portion increases, and a part of the ink discharges into the negative pressure producing material chamber from the ink accommodating portion through the air-liquid exchange passage. Since the inside volume of the ink accommodating portion increases, the amount of the ink flowing into the negative pressure producing member (which results in the rise of the liquid level in the negative pressure producing member shown by (3) in FIG. 13(*c*1)) is significantly smaller than when the ink accommodating portion is non-deformable. When the pressure change is abrupt, the amount of the ink flowing out through the air-liquid exchange passage eases the negative pressure i the ink accommodating portion, and increases the inside volume of the ink accommodating portion, and therefore, at the initial stage of the change, the resisting force of the wall surface provided by easing the inward deformation of the ink accommodating portion and the resisting force against the injection into the negative pressure generating member, are ruling.

The flow resistance against this injection is larger than the resistance against the restoration of the ink accommodating portion, so that when the air expands, the inside volume of the ink accommodating portion increases, as shown in FIGS. 13(*a*1) and 13(*a*2). When the increase of the volume due to the expansion of the air is larger than the upper limit of this increase, the ink flows out into the negative pressure producing material chamber from the ink accommodating portion through the air-liquid exchange passage, as shown in FIGS. 13(*b*1) and 13(*b*2). Thus, the walls of the ink accommodating portion function as a buffer against ambient condition changes, so that movement of the ink in the negative pressure producing member is slow, and therefore, the negative pressure property at the ink supply port is stabilized.

In this embodiment, the ink discharged into the negative pressure producing material chamber is retained by the negative pressure producing member. In this case, as shown in FIGS. 13(*c*1) and 13(*c*2), the amount of the ink in the negative pressure producing material chamber temporarily increases with the result of rising of the air-liquid interface, and therefore, similarly to the initial stage of the use, the ink pressure becomes temporarily slightly positive as compared with the pressure in the stable period, but the influence to the ejection property of the liquid ejection recording means such as a recording head is practically small enough. When the ambient pressure returns to the level before the pressure reduction (1 atm.) or when the temperature returns to the initial temperature), the ink discharged from the ink accommodating portion and retained in the negative pressure producing member due to the ambience change returns to the ink accommodating portion, and the volume of the ink accommodating portion returns, too.

Figure 14A:
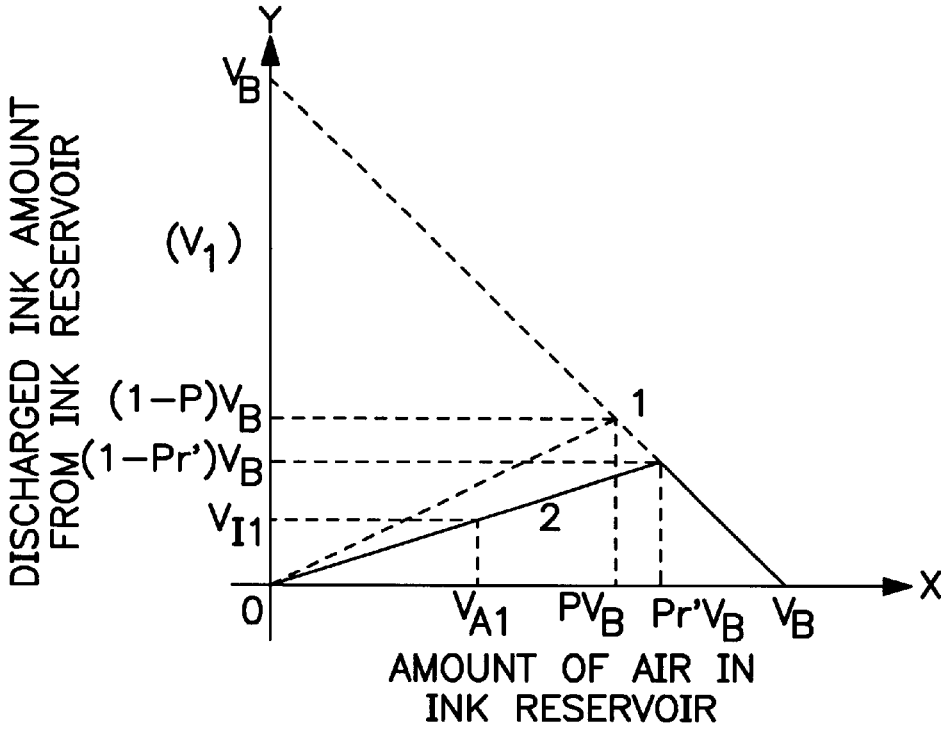
FIGS. 14(*a*)–14(*b*) are illustrations of an amount of ink discharging when the pressure in the ink container shown in FIGS. 1(*a*) and 1(*b*) is reduced, wherein FIG. 14(*a*) is an illustration of a relation between a volume of an initial space of the ink accommodating chamber before the pressure reduction and an amount of ink discharging upon pressure reduction, and FIG. 14(*b*) show an amount of ink discharge from the ink accommodating portion and a change, with time, of the volume of the ink accommodating portion when the ambience pressure of the container is changed from ambient pressure to P atm. (0P<1) (pressure-reduced state).
Figure 14B:
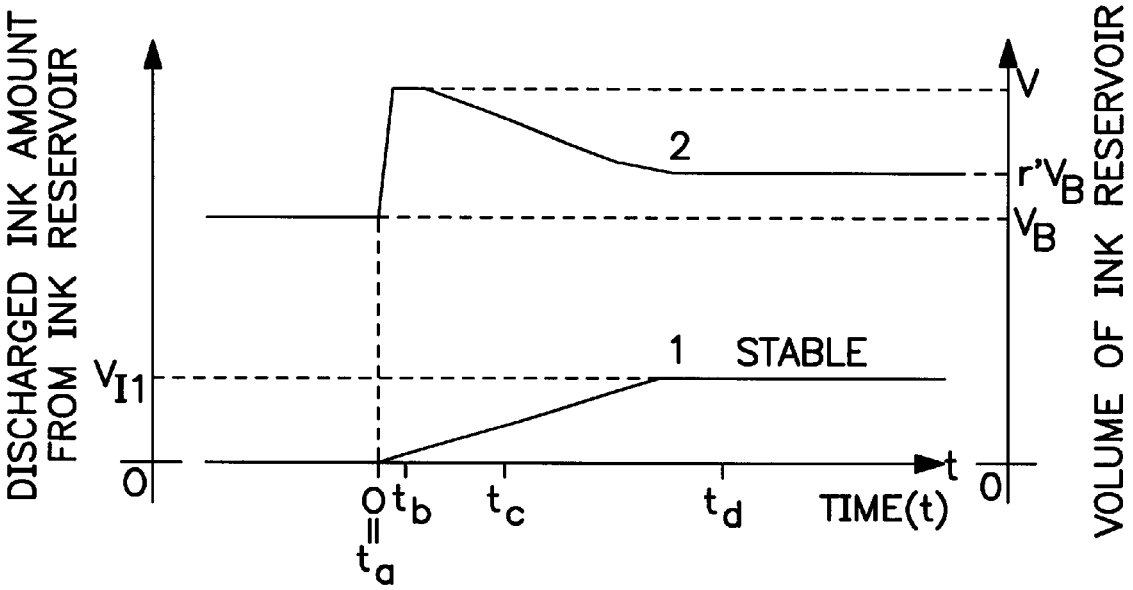

Referring to FIGS. 14(*a*) and 14(*b*), the description will be made as to operation when the stable state shown in FIGS. 13(*d*1) and 13(*d*2) is reached under the changed pressure after the initial operation after the pressure change.

This case is characterized by the change of the interface of the ink retained in the negative pressure producing member so that balance is maintained against the changes of not only the amount of the ink discharged from the ink accommodating portion but also the negative pressure due to the volume change of the ink accommodation per se As regards the relation between the amount of the ink absorption of the negative pressure producing member and the ink accommodating chamber in the present invention, from the standpoint of prevention of the ink leakage through the air vent upon the pressure reduction and temperature change, the maximum ink absorption amount of the negative pressure producing material chamber is determined in consideration of the ink discharge amount from the ink accommodating chamber under the worst condition and the amount of the ink to be retained in the negative pressure producing material chamber during the ink supply from the ink accommodating chamber, and the thus determined volume of the negative pressure producing member is contained in the negative pressure producing material chamber.

FIG. 14(*a*) shows a volume of the initial space (volume of the air) of the ink accommodating chamber when the ink accommodating portion does not deform at all against the expansion of the air (abscissa (X)) vs the amount of the ink discharge when the pressure is reduced to Patm. (0<P<1) (ordinate (Y)) (broken line (1)).

As will be understood from the graph, the amount of the ink discharge δV is approximately expressed as follows, where P is the pressure upon the pressure reduction ((0<P<1), a is a ratio of the initial air amount in the ink accommodating chamber ((0≦a≦1), and VB is a volume of the ink accommodating portion.

(1) When 0≦a<P

The amount of the air in the ink accommodating chamber expanded by the pressure reduction, is large when the amount of the remainder is small, so that large amount of the ink is discharged, and therefore, the amount of the ink discharge δV is proportional to the amount of the initial air:

$$\delta V=((1-p)/p)\times a\times V_B \quad (1)$$

(2) When P≦a≦1

The amount of discharge cannot be larger than the amount of the ink in the ink accommodating chamber, it depends on the amount of the ink accommodated initially:

$$\delta V=(1-a)\times V_B \quad (2)$$

Therefore, the estimation of the ink discharge amount from the ink accommodating chamber under the worst condition is such that when the maximum pressure reduction condition of the ambient pressure is 0.7 atm., the maximum amount of the ink discharging from the ink accommodating chamber occurs when the volume VB of the ink in the ink accommodating chamber remains in the ink accommodating chamber. If the ink below the bottom end of the ink chamber wall is also absorbed by the compressed absorbing material in the negative pressure producing material chamber, then all the ink (30% of VB) remaining in the bottom end portion m is considered as leaking out. In the present invention, however, the ink accommodating portion deforms in response to the expansion of the air, so that inside volume of the ink accommodating portion after the expansion is larger than the inside volume of the ink accommodating portion before the expansion, and the ink retaining level in the negative pressure producing material chamber changes so as to maintain the balance against the variation of the negative pressure due to the deformation of the ink accommodating portion. In the stable state, the negative pressure balance with the negative pressure producing member in which the negative pressure is reduced is kept by the ink from the ink accommodating portion (the negative pressure in the ink supply port in the negative pressure producing material chamber is Q). When the reduced pressure is P (0<P<1); a ratio of the amount of the initial air in the ink accommodating chamber shown in FIGS. 13(*a*1) and 13(*a*2) is a (0≦a≦1); a volume of the ink accommodating portion before the expansion, shown in FIGS. 13(*a*1) and 13(*a*2) is VB; a volume of the ink accommodating portion at the initial state (or the state in which the outer surface of the inner wall is closely contacted to the inner surface of the outer wall) is V; the volume of the ink accommodating portion in the stable state is VQ ($r=V/V_B$ (r>1), $r'=V_Q/V_B$ (1<r'≦r), then the amount δV of the ink discharge is approximately:

(3) When 0≦a<P×r'

In this case, the ink accommodating portion expands and discharge the ink. Since the ink discharge amount δV from the ink accommodating portion is a difference between the amount of the volume change of the air in the ink accommodating portion and the amount of expansion of the ink accommodating portion under the balanced state, $$\delta V=((1-p)/p)\times a\times V_B-(r'-1)\times V_B \quad (3)$$

Thus, the ink discharge amount is smaller by the amount of expansion in the ink accommodating portion. The amount of expansion of the ink accommodating portion (r'−1) VB has a relation with the negative pressure generated by the negative pressure producing member, and the negative pressure of the negative pressure producing member has a relation with the amount of ink discharge of the ink accommodating portion. An example of the relations will be described. The amounts of the ink in the ink accommodating portion before the pressure variation and in the stable state will be considered. In FIGS. 13(*d*1) and 13(*d*2), it is assumed that negative pressure producing member is a capillary force generating member having uniform capillary force generation elements (no local unevenness) each of which is in the form of tubes having a bottom surface area S, and that liquid level in the stable state shown in FIGS. 13(*d*1) and (*d*2) rises by δh from the state before the ambient condition change shown in FIGS. 13(*a*1), (*a*2).

$$\delta V = S \times \delta h \tag{4}$$

At this time, the negative pressure generated at the ink supply port of the negative pressure producing member is changed by δQ from that before the pressure variation toward the positive pressure direction.

$$\delta Q = \delta h \tag{5}$$

On the other hand, the difference between the negative pressures in the ink accommodating portion between before the pressure variation and in the stable state is equal to δQ since the negative pressure balance is kept with the negative pressure producing member. The relation between the difference in the negative pressure and the amount of volume variation is dependent on the configuration of the ink accommodating portion, but they are generally proportional, before the opposite maximum area sides are contacted together. The proportional constant is k (k>0).

$$\begin{aligned} \delta Q &= k \times (V_Q - V_B) \\ &= k \times (r' - 1) \times V_B \end{aligned} \tag{6}$$

From equations 4 to 6

$$\delta V = S \times k \times (r' - 1) \times V_B \tag{7}$$

From equations 3 to 7

$$\begin{aligned} \delta V &= ((S \times k)/(1 + S \times k)) \times ((1 - p)/p) \times a \times V_B \\ &= (1/(1 + b)) \times ((1 - p)/p) \times a \times V_B \end{aligned} \tag{8}$$

When the opposite maximum area sides of the ink accommodating portion are contacted to each other before the pressure variation, the relation between the volume of the ink accommodating portion and the generated negative pressure is different depending on whether they are contacted or not. Therefore, the relation between the initial space volume of the ink accommodating chamber before the pressure reduction and the ink discharging amount is not linear as represented by equation 8, but has an inflection point. When the cross-sectional areas of the negative pressure producing members are different depending on the heights, or when the densities of the capillary force generation elements are not uniform, the respective factors are taken into account. In equation 3, when V<0, then V=0. In other words, the movement of the ink does not occur through the air-liquid exchange passage (communicating portion) in this state, and only the expansion of the inside volume of the ink accommodating portion occurs.

(4) When $P \times r' \leqq a \leqq 1$

The amount of discharge cannot be larger than the amount of the ink in the ink accommodating chamber, it depends on the amount of the ink accommodated initially:

$$\delta V = (1 - a) \times V_B \tag{9}$$

FIG. 14(*a*) shows a volume of the initial space of the ink accommodating chamber (volume of the air) before the pressure reduction abscissa (X) vs an ink discharge amount in the stable state when the pressure is reduced to Patm. (0<P<1) ordinate (Y) solid line (2)). Under the above-described condition, the ink discharge amount has an inclination which is less steep by 1/(1+b)(0<b=1/(S×k)), as shown by the solid line in FIG. 14(*a*).

As will be understood from the broken line (1) and the solid line (2) in FIG. 14(*a*), the estimation of the ink discharging amount from the ink accommodating chamber under the worst condition, can be made smaller then when the ink accommodating portion does not deform at all in response to the expansion of the air. This phenomenon applies upon the temperature change of the ink container, and therefore, the discharging amount is smaller during the pressure reduction even if the temperature rises approx 50 deg.

As described in the foregoing, according to the ink container of the present invention, the expansion of the air in the ink accommodating chamber due to the change of the ambience condition, can be accommodated not only by the negative pressure producing material chamber but also by the ink accommodating chamber having the buffer effect provided by the increase of the volume of the ink accommodating chamber per se until the outer periphery of the ink accommodating portion becomes substantially equal to the inner periphery of the casing. Thus, the ink accommodation capacity of the ink accommodating chamber can be significantly increased while accepting the ambient condition change.

FIG. 14(*b*) schematically shows the volume of the ink accommodating portion and the ink discharge amount from the ink accommodating portion, with time, when the ambience of the container is changed from the atmospheric pressure (t=0) to Patm. (0<P<1) (pressure-reduced state) wherein the volume of the air at the initial stage is VA1. In FIG. 14(*b*), the abscissa represents time (t), and the ordinate is a volume of the ink accommodating portion and the amount of the ink discharge from the ink accommodating portion, wherein change, with time, of the amount of the ink discharge from the ink accommodating portion is indicated by, and the solid line (1), and the change, with time, of the volume of the ink accommodating portion is indicated by the solid line (2). In FIG. 14(*b*), the states of the ink container corresponding to t=ta, t=tb, t=tc, t=td are shown in FIGS. 13(*a*1)–13(*d*2), respectively.

As shown in FIG. 14(*b*), upon abrupt ambience change, the ink accommodating chamber can accommodate the expansion of the air, before the stable state wherein the negative pressures are balanced between the negative pressure producing material chamber and the ink accommodating chamber, is finally reached. Therefore, the ink discharge timing (from the ink accommodating chamber to the negative pressure producing material chamber) can be delayed upon an abrupt ambient condition change.

Therefore, according to the ink supplying system of the present invention, even under the various use condition, the tolerance for the air expansion of the air introduced by the air-liquid exchange is enhanced, and the ink supply is accomplished with stabilization negative pressure during the use of the ink accommodating chamber. According to the ink supplying system of the present invention, the volume ratio between the negative pressure producing material chamber and the ink accommodating chamber can be determined relatively freely by properly selecting the material of the ink accommodating portion and the negative pressure producing member, even to the extent of 1:2 or larger with practicality. When the buffer effect of the ink accommodating chamber is important, the deformation of the ink accommodating portion in the air-liquid exchange state from the state at start of use is increased within the range of the elastic deformation.

For the purpose of effective buffer effect of the ink accommodating portion, it is desirable that amount of the air in the ink accommodating portion when the deformation of the ink accommodating portion is small, namely, that amount of the air in the ink accommodating portion of the function in the ink accommodating portion before the air-liquid exchange state after the connection, is small.

In the foregoing, first embodiment has been described. Another embodiment will be described. In the following embodiments and in the foregoing embodiment, various elements can be combined.

(Second Embodiment)

Figure 15:
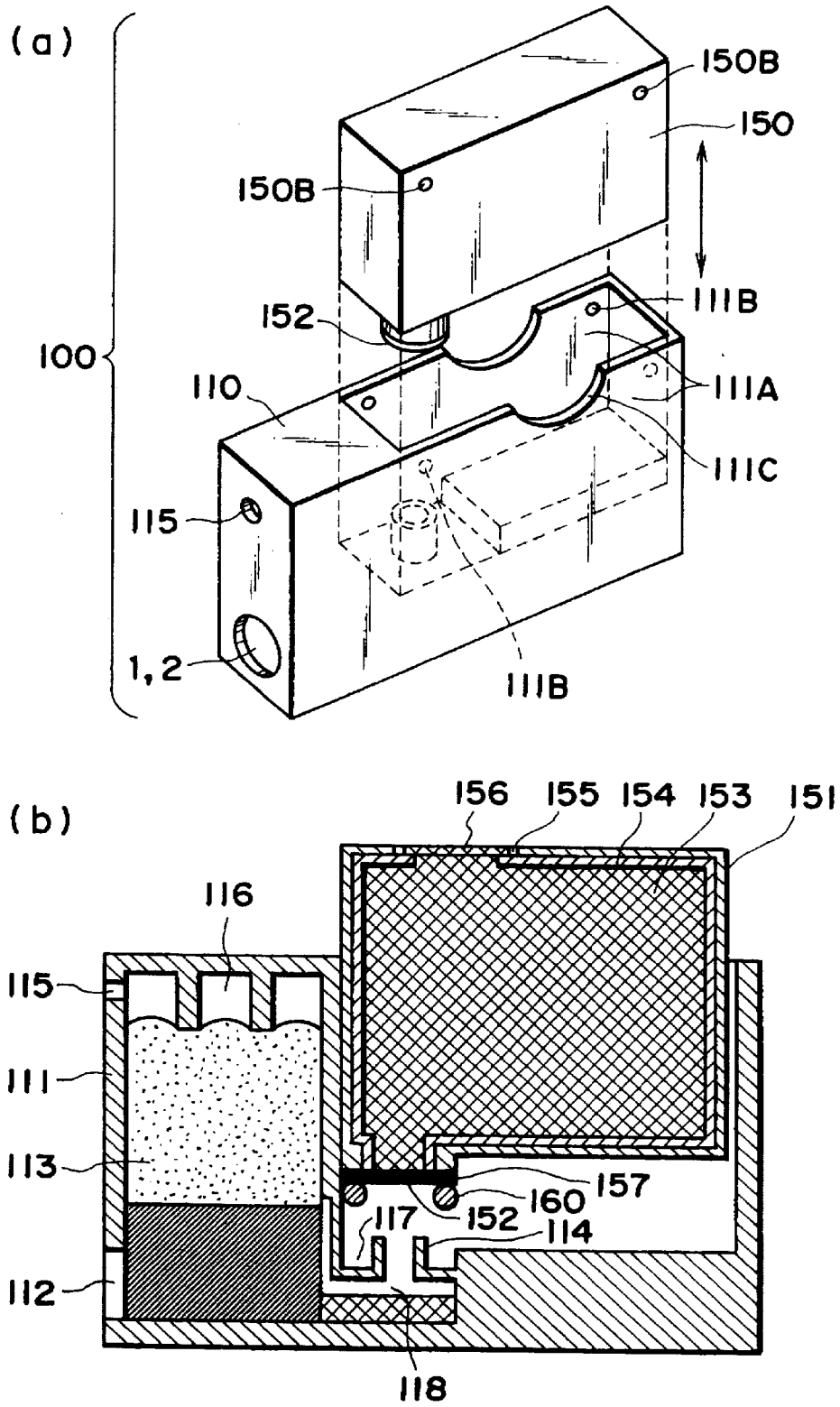
FIGS. 15(*a*) and 15(*b*) are schematic illustrations of an ink container usable with the liquid supply system of the present invention according to a second embodiment, wherein FIG. 15(*a*) a perspective view thereof, and FIG. 15(*b*) is a sectional view thereof.

FIGS. 15(*a*)–15(*b*) are schematic illustrations of an ink container according to a second embodiment to which the liquid supply system of the present invention is applicable, wherein (a) is a perspective view, (b) is a sectional view. In this embodiment, a communication tube(air-liquid exchange passage) 114 is projected upwardly in the vertical direction from a side opposed to the bottom surface of the negative pressure producing material chamber 110, and a liquid plenum 118 is provided at a negative pressure producing material chamber side end of the communication tube in place of contact with the negative pressure producing member, and the casing of the negative pressure producing material chamber 110 is provided with a guiding member 111A for guiding the ink accommodating chamber 150. These are different from first embodiment. Lateral sides of the ink accommodating chamber 150 are provided with respective projected portions 150B, and correspondingly, the guiding member 111A is provided with recesses 111B. In the other respects, the structure is similar to that of the container according to Embodiment 1. A negative pressure producing material chamber 110 holds a negative pressure producing member 113 in a casing 111, and is provided with an ink supply port 112, an air vent 115, a buffer portion 116 and an air introducing groove 117. The ink accommodating chamber 150 has an ink accommodating portion 153 constituted by the inner wall 154 having an outer surface corresponding to the inner shape of the casing(outer wall) 151. It has air vent 155, a pinch-off portion 156 and an ink discharging outlet 152 sealed by sealing means 157 such as a film. The ink discharge port 152 is provided with an O-ring 160 as a seal member, and when the negative pressure producing material chamber and the ink accommodating chamber are connected to each other, the connecting portion is seal thereby.

By the provision of the communication tube extended from a side opposite to the bottom surface of the negative pressure producing material chamber, the ink accommodating chamber can be easily mounted to or demounted from the negative pressure producing material chamber in a direction perpendicular to the bottom surface of the negative pressure producing material chamber. At this time, the positioning between the ink discharge port of the ink accommodating chamber and the communication tube of the negative pressure producing material chamber can be easily effected by a guiding member 111A. Therefore, when the sealing means 157 is unsealed, the communication tube is free of additional force, thus permitting assured connection. The container is fixed by engagement between a projected portion 150B provided in the ink accommodating chamber and a recess provided in the guiding member 111A, and the seal of the connecting portion is assured together with the O-ring. A cut-away portion 111C provided in the guiding member is used when the ink accommodating chamber is dismounted.

In this embodiment, the liquid plenum is not inevitable by using L-shaped communication tube, for example. As regards the liquid plenum, the volume is preferably as small as possible, since then the amount of the air moving into the ink accommodating chamber upon the connection can be reduced. If it is necessary to use a liquid plenum having a large size, the liquid plenum may be provided with a liquid detecting mechanism (for example, two electrodes are disposed in the liquid plenum, and the resistance value between the electrodes is measured).

(Third Embodiment)

Figure 16B:
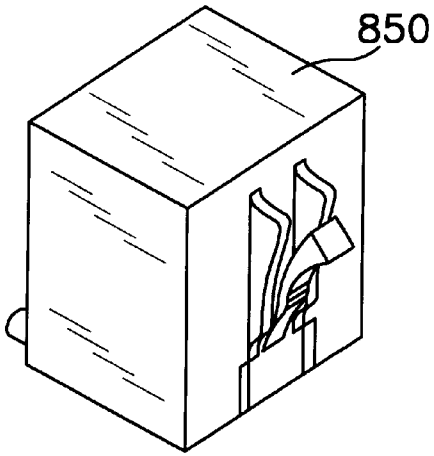
FIGS. 16(*a*)–16(*b*) are schematic illustrations of an ink container usable with a liquid supply system according to a third embodiment.
Figure 16A:
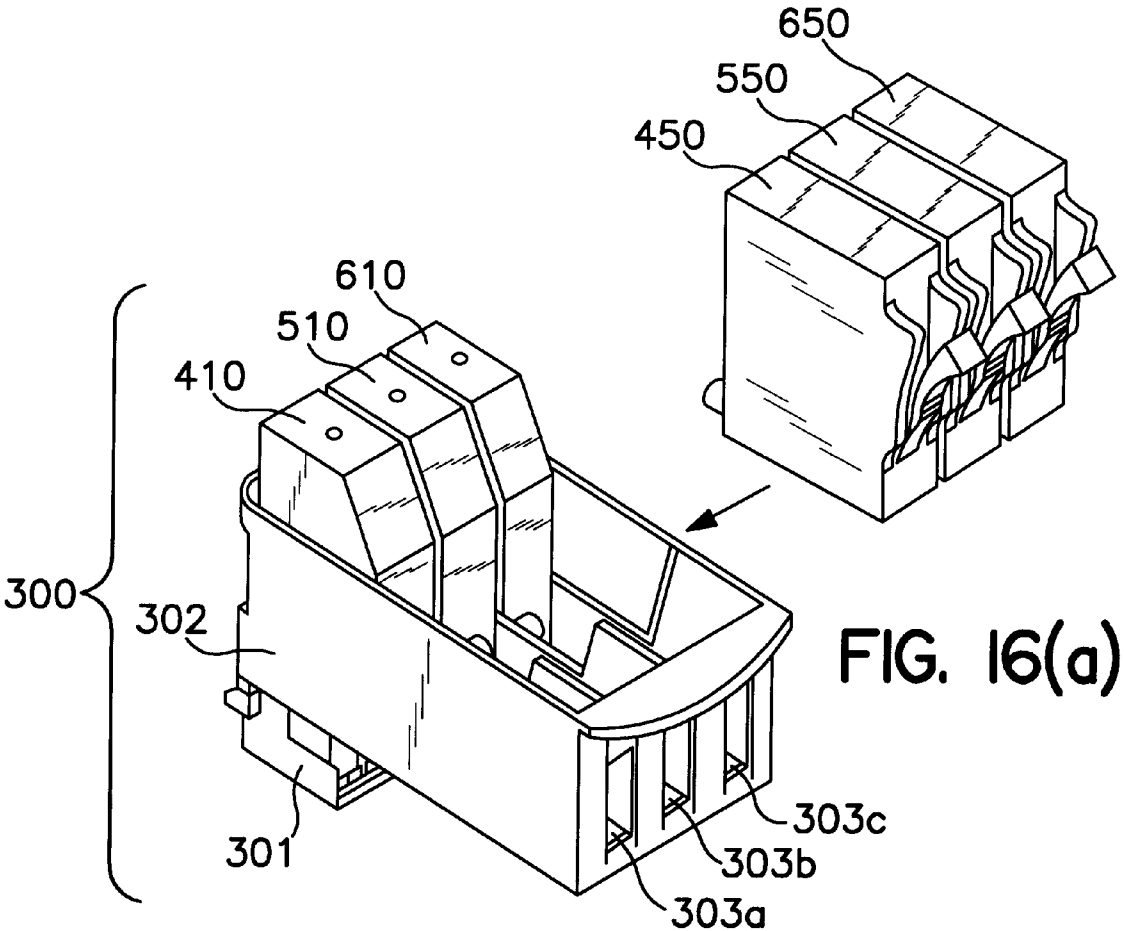

FIG. 16(*a*) is a schematic illustration of an ink container according to a third embodiment, usable with the liquid supply system according to the present invention.

In this embodiment, an integral head cartridge 300 is constituted by liquid ejection portions 301 capable of ejecting different liquids (yellow (Y), magenta (M) and cyan (C) inks in this embodiment) and negative pressure producing material chambers 410, 510, 610 accommodating the liquids, wherein the ink accommodating chambers 450, 550, 650 are detachably mountable relative to the head cartridge 300.

In this embodiment, in order to assure the connection between the ink accommodating chambers and the associated negative pressure producing material chambers, the head cartridge 300 is provided with a holder portion 302 which coverings a part of outer surfaces of the ink accommodating chambers. The ink accommodating chambers are provided with latch levers 459, 559, 659 having locking claws. A guiding member is provided with engaging holes 303*a*, 303*b*, 303*c* corresponding to the locking claws. Therefore, the connecting state is maintained assuredly. The respective liquid containers 450, 550, 650 have substantially the same configurations, and by provision of identification label (unshown) for preventing erroneous mounting, the correct mounting is assured. The holder configurations may be different depending on the colors to prevent the erroneous mounting. In this case, the volumes may be made different taking the use frequencies of the colors into account. As a modified example of the embodiment, the negative pressure producing material chambers 410, 510, 610 may be made separable relative to the liquid ejection portion, as shown in FIG. 16(*b*). In this case, only one black (Bk) may be provided on the ink accommodating chamber. By the integral configuration as in this embodiment, the erroneous mounting of the container can be prevented.

In this embodiment and the modified example thereof, the liquids may be other than the Y, M and C inks, and the number and combination of the accommodated liquid containers (for example, only black (Bk) container is a single container, and Y, M, C containers constitute an integral container).

(Other Embodiments)

Other embodiments and modifications will be described. The following embodiments are applicable to each of the above-described embodiments.

(Structure of the Ink Accommodating Chamber)

Additional description will be made as to the structure of the ink accommodating chamber in each of the embodiments described above.

When the ink accommodating chamber is detachably mountable relative to the negative pressure producing member, a sealing means is provided at the communicating portion between the ink accommodating chamber and the negative pressure producing material chamber to prevent leakage of the ink from the ink accommodating portion before the connection and to prevent leakage of the liquid and/or the air through the communicating portion upon connection. In this embodiment, the sealing means is in the form of a film-like, but it may be ball-like. Alternatively, the air-liquid exchange passage may be provided by a hollow needle, and the sealing means is a rubber plug.

The Ink accommodating chamber of each of the above-described embodiments are manufactured by a direct blow manufacturing method. The casing(outer wall) and the ink accommodating portion(inner wall) which are separable from each other, are provided by uniformly expanding a cylindrical parison to a substantially a prism-like mold by air blow. In an alternative structure, a metal spring or the like may be provided in a flexible bladder, so that negative pressure is generated in accordance with ink discharge.

Figure 17B:
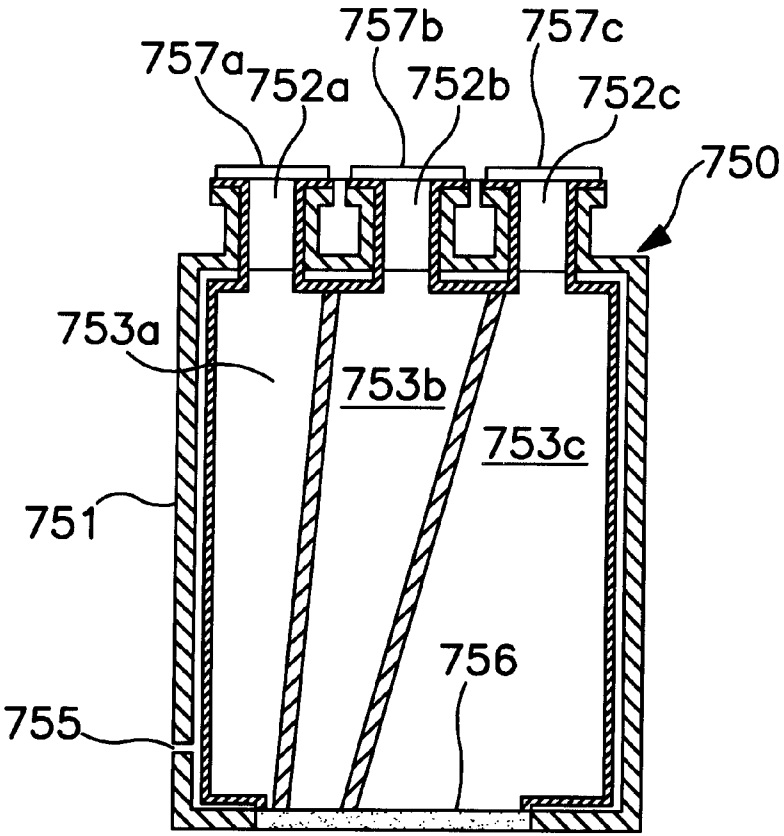
FIGS. 17(*a*) and 17(*b*) are schematic illustrations of a modified example of an ink container usable with a liquid supply system of the present invention, wherein FIG. 17(*a*) is a perspective view thereof, and FIG. 17(*b*) is a sectional view thereof.
Figure 17A:
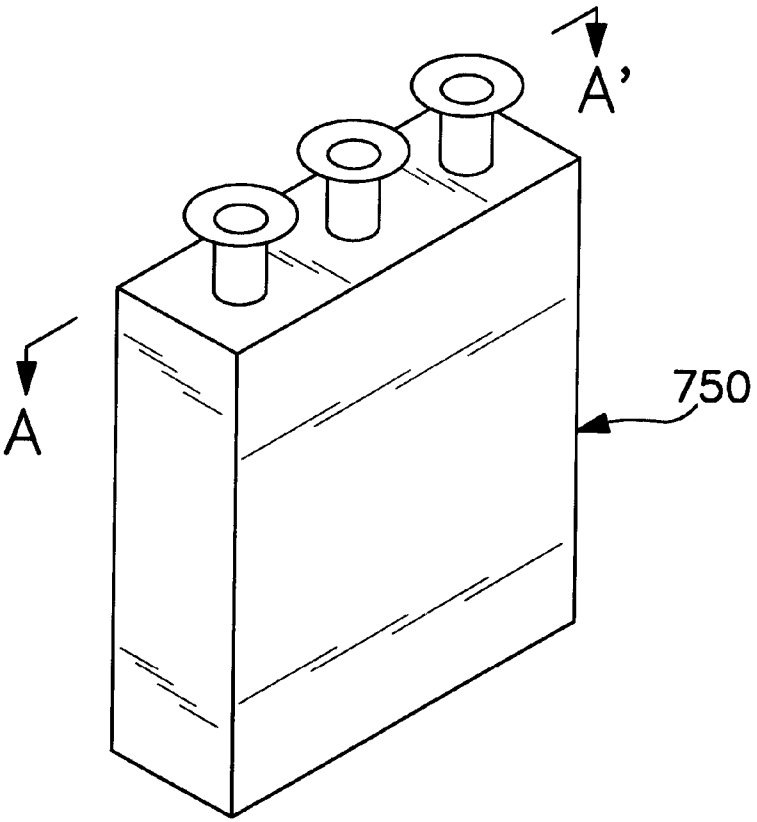

However, by using blow molding, the ink accommodating portion having an outer surface configuration similar to or equivalent to the inner surface configuration of the casing can be easily manufactured, and in addition, the negative pressure level generated can be easily selected by changing the material and the thickness of the inner wall constituting the ink accommodating portion. By using thermoplastic resin material for the outer wall, the ink accommodating chamber can be recyclable. By using the blow molding, the ink container shown in FIG. 17 can be easily manufactured for the integral type container as has been described with third embodiment. FIG. 17 is a perspective view of an example of an ink accommodation container with plural ink accommodating chambers, wherein (b) is a sectional view taken along an A—A in FIG. 17(*a*). The ink accommodation container 750 has a plurality of ink accommodating portions 753*a*, 753*b*, 753*c* for retaining the inks, and ink discharge ports 752*a*, 752*b*, 752*c* sealed by the sealing means 757*a*, 757*b*, 757*c* can be connected. In the ink accommodation container 750 shown in FIG. 17, the sizes of the ink accommodating portions are different. By the difference, the accommodation capacities can be made different depending on the use frequencies of the liquids. The description will be made as to the structure of the outer wall and the inner wall.

In each of the above-described embodiments, the ink accommodating chamber is manufactured by the blow molding, and therefore, the thickness is smaller in the corner portions than in the central portions of the sides. Similarly, the thickness of the outer wall is smaller in the corner portions than in the central portions of the sides.

As a result, the inner wall acquires the outer shape which is the same as the inner shape of the outer wall. The outer surface of the inner wall extends along the thickness distribution of the outer wall, and therefore, it is convex toward the ink accommodating portion constituted by the inner wall. The inner surface of the inner wall has the above-described thickness distribution, and therefore, it is further convex toward the ink accommodating portion. These structures result in the above-described function in the maximum area sides, and therefore, the convex shape is desirable at least in the maximum area sides, thedegree of convexity of the internal wall surface may be not more than 2 mm, and that of the outer surface of the inner wall may be not more than 1 mm. The convex shape may be within a measurement error range in a small area sides. Thus, the convex shapes determine the priority of deformation of the sides.

The structure of the outer wall will be described. The above-described outer wall has a function of limiting the deformation of the inner wall at the corner portions. For this function, it can maintain the configuration thereof against the deformation of the inner wall, and it covers the outside of the corner portions (corner portion enclosing member). The outer wall or the inner wall may be covered by plastic resin material, metal or thick paper. The outer wall may cover the whole surface, or only the corner portions have a surface structures, which are connected each other with metal rods or with a mesh structure.

If the ink is disconnected between the neighborhood of the air-liquid exchange path of the negative pressure producing member and the neighborhood of the ink supply port for some reason or another when the ink accommodating chamber is exchanged in the case of the exchangeable ink accommodating chamber, the ink in the ink accommodating chamber can be forced into the negative pressure producing material chamber by temporarily presses the outer wall which is elastically deformable manually, as shown in FIG. 18, by which the ink can be made continuous. The pressing refreshing process may be effected automatically rather than manually. Means for the pressing can be provided in the recording device. When the structure is such that art of the inner wall is exposed, the exposed portion f the inner wall can be pressed.

In this embodiment, the ink accommodating portion has a prism-like shape, but the shape is not limiting. It may be any, if it is deformable with the ink discharge and is capable of generating the negative pressure despite the deformation.

It is preferable that one-to-one relation between the deformation of the ink accommodating portion and the negative pressure at the ink discharge port can be maintained, even if the deformation and the restoration of the ink accommodating portion are repeated This can be accomplished by deforming the ink accommodating portion within the elastic deformation range.

In this embodiment, even if the pressure at the ink discharge portion becomes zero after the air-liquid exchanging operation, the ink accommodating portion is still kept deformed slightly. So, even if the deformation of the ink accommodating portion is not elastic in a part, it is usable if the other part deforms elastically.

When the ratio of the change of the negative pressure due to the deformation of the ink discharge abruptly changes (for example, by the deformed portions being abutted to each other), it is desirable that above-described first ink supply state is completed and the above-described second ink supply state is started before the abrupt change, even if the elasticity still exist even after the change. The material for the use in the liquid accommodating container may be any if the inner wall and the outer wall are separable, and each or one of the inner wall and the outer wall may be of multi-layered structure of a plurality of materials. A higher elasticity material is usable for the inner wall than when the ink accommodating chamber alone is used as an accommodating container. Therefore, as compared with the case when the ink accommodating chamber alone is used as a negative pressure producing container, a thicker inner wall or a more rigid material are usable for the replenishing ink chamber for ink jet printing, thus expanding the latitude of material selection. Increase of the thickness of the inner wall is effective to lower the gas permeability of the ink accommodating chamber. The decrease of the gas permeability is preferable since the expansion and/or the ink leakage of the ink accommodating chamber can be prevented when the ink accommodating chamber is transported or kept unused. In consideration of the influence to the ink accommodated inside, the preferable material of the inner wall is for example polyethylene resin material, polypropylene resin material or the like. In the foregoing embodiments and examples, the inner wall and the outer wall have a single layer structure, but the inner wall and/or the outer wall may be of a multi-layer structure. Particularly, in the present invention, as compared with the case when the ink accommodating chamber alone is used as a negative pressure producing container, a thicker inner wall or a more rigid material are usable for the replenishing ink chamber for ink jet printing, thus expanding the latitude of material selection, the number of combinations of the materials for the inner wall is larger. (Structure of the negative pressure producing material chamber).

Additional description will be made as the structure of the negative pressure producing material chamber in each of the embodiments.

The negative pressure producing member accommodated in the negative pressure producing material chamber (accommodating container for the negative pressure producing material) may be a porous member or material such as polyurethane foam, felt-like material of fibers, heat-molded mass of fibers or the like. The air-liquid exchange passage (communicating portion) has been described as being tube like, but it may be any if the air-liquid exchange is not obstructed in the air-liquid exchange state.

Figure 19:
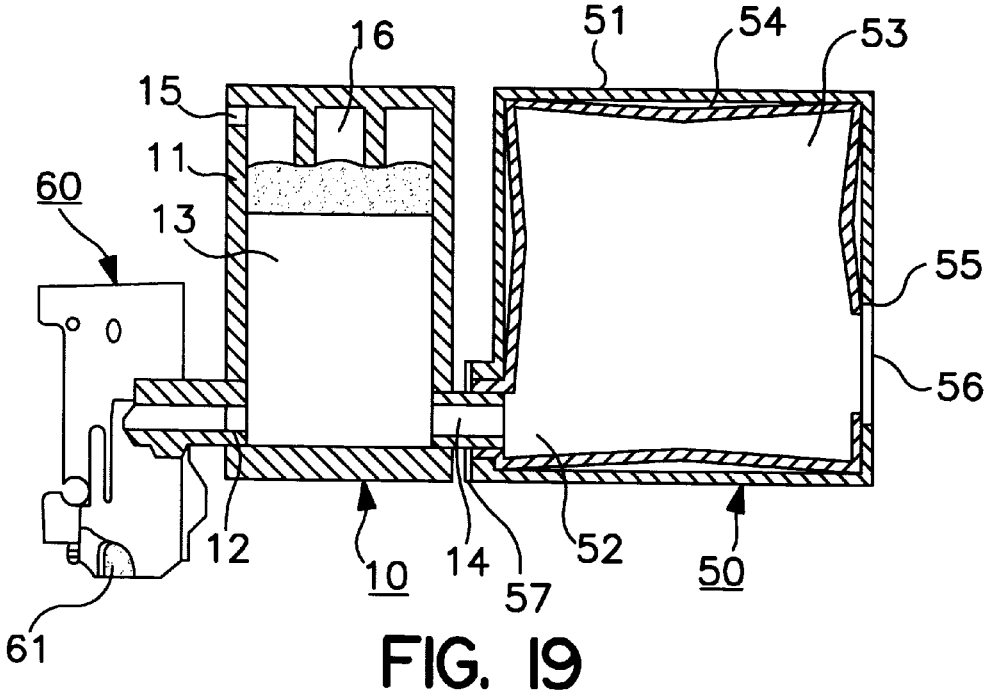
FIG. 19 is a schematic sectional view of a modified example of an ink container usable with the liquid supply system of the present invention.

In each of the embodiments, the air introducing groove is formed on the inner surface of the casing, but it is not inevitable as shown in FIG. 19. FIG. 19 is a sectional view of a container according to the first embodiment, but the air introducing groove may be omitted in the other embodiments. In this embodiment, the liquid level is generally maintained at a lower position during the air-liquid exchanging operation. In this case, when a large amount of the ink is discharged, in the above-described solid mode printing, the liability of occurrence of the ink discontinuance is higher than when the air introducing groove is provided. However, when the ink accommodating chamber is deformable, the discharge amount of the ink during the air-liquid exchange, is large so that liability of occurrence of the ink discontinuance is lower. By the provision of the air introducing groove for promoting the air-liquid exchange, the air-liquid interface can be easily formed, so that ink supply is further stabilized. In other words, the liquid supplying operation to the outside such as the recording head is stabilized. The air-liquid interface is further stabilized by taking into account the connection between the negative pressure producing member; and the ink accommodating portion under various conditions such as the first supply state and the second supply state.

In each of the foregoing examples, a space (buffer portion) not having the negative pressure producing member is provided adjacent the top portion, but this space may be replaced with the negative pressure producing member not containing the liquid under the normal conditions. By the provision of the negative pressure producing member not retaining the liquid in the buffer space, the ink moved to the negative pressure producing material chamber due to the ambient condition change can be retained.

(Ink Container)

Figure 20:
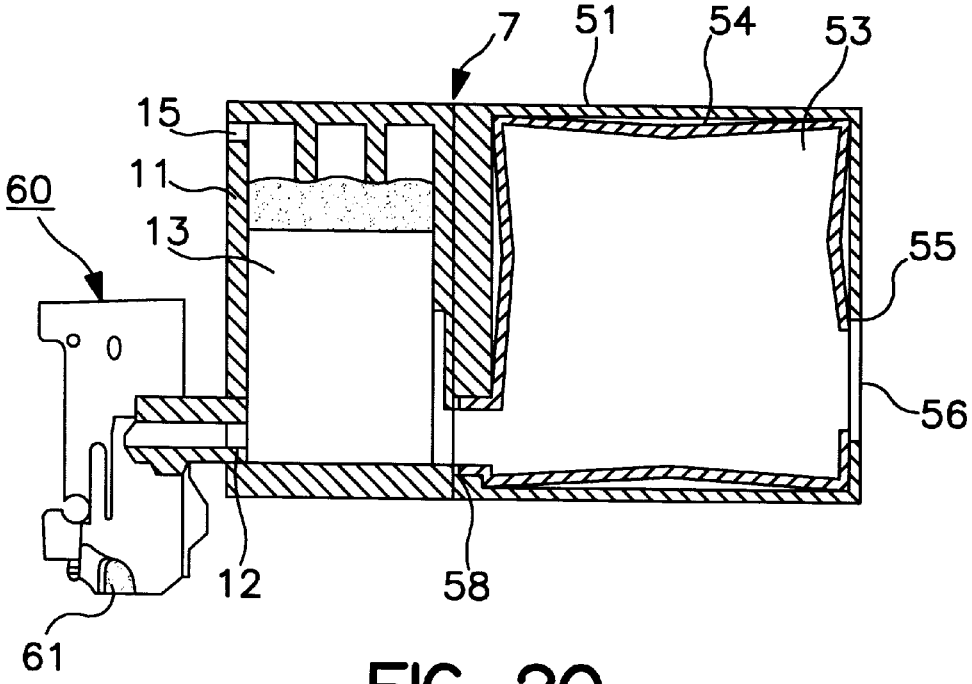
FIG. 20 is a schematic sectional view of a modified example of an ink container usable with a liquid supply system of the present invention.

In each of the foregoing embodiments, the ink accommodating chamber has been described as being detachably mountable relative to the negative pressure producing material chamber, but as shown in FIG. 20, the two chambers may be always integral. In the case that after the chambers are molded through different molding methods (for example, injection molding for the negative pressure producing material chamber, and blow molding for the ink accommodating chamber), they are welded or bonded (integral), the communicating portion is desirably sealed by a sealing member such as O-ring 58, similarly to the above-described embodiments so as to prevent ink leakage from the communicating portion where the two chambers are connected.

The liquid supplying operation in the ink container shown in FIG. 20 at the start of the use, is already at the stage after the completion of the above-described state at start of use. The advantageous effects of the foregoing embodiments can be used in the other supply operation stages.

(Liquid Supplying Operation and Ink Supplying System)

An additional description will be made as to the liquid supplying operation and the ink supplying system. As regards the ink supply operation in the ink container (ink supplying system) in each of the foregoing embodiments, the operations proceed from the initial state where the ink accommodating chamber and the negative pressure producing material chamber are not connected, the state at start of use (upon connection therebetween), the first and second ink supply states. They are one example of liquid supplying operation in the ink supplying system of the present invention, and the following operations, for example, may occur depending on the structures of the ink accommodating chamber and the negative pressure producing material chamber and/or the liquid discharge condition.

In a first modified example, with an ink supplying system without the air-liquid exchange state namely the second ink supply state, there is a process of using the ink from the ink accommodating portion without the introduction of the ambience into the ink accommodating portion, and therefore, as regards the limit of the inside volume of the liquid accommodating container, the air introduced into the ink accommodating portion upon the connection has only to be considered. Thus, even if the limit to the inside volume of the ink accommodating chamber is eased, the ambient condition change can be accommodated. This is advantageous. However, when the usage efficiency of the ink accommodating portion is considered, the ink in the ink accommodating portion can be more easily consumed when the air-liquid exchange state occurs after the first ink supply state, as in each of the foregoing embodiments.

As regards the second modified example, the liquid level of the negative pressure producing material chamber before the connection is higher than the air-liquid interface as the case may be in the state shown in FIGS. 2(*a*1), (*a*2). In this case, among the motions of the ink toward the state at start of use disclosed referring to FIGS. 2(*b*1), (*b*2), the unidirectional ink movement due to the capillary force into the negative pressure producing material chamber.

In a third modified example, the consumption speed of the ink is extremely high in the state shown in FIGS. 3(*b*1), (*b*2), for example. In this case, the negative pressures of them are not always balanced, but the ink in the negative pressure producing material chamber is first consumed until the difference of the negative pressures of them, and when the difference of the negative pressures becomes larger than a predetermined level, the ink moves from the ink accommodating chamber into the negative pressure producing material chamber. Such modified examples are within the sprit of the present invention with the ink supply operation and the detail.

(Liquid Ejection Recording Device)

Figure 21:
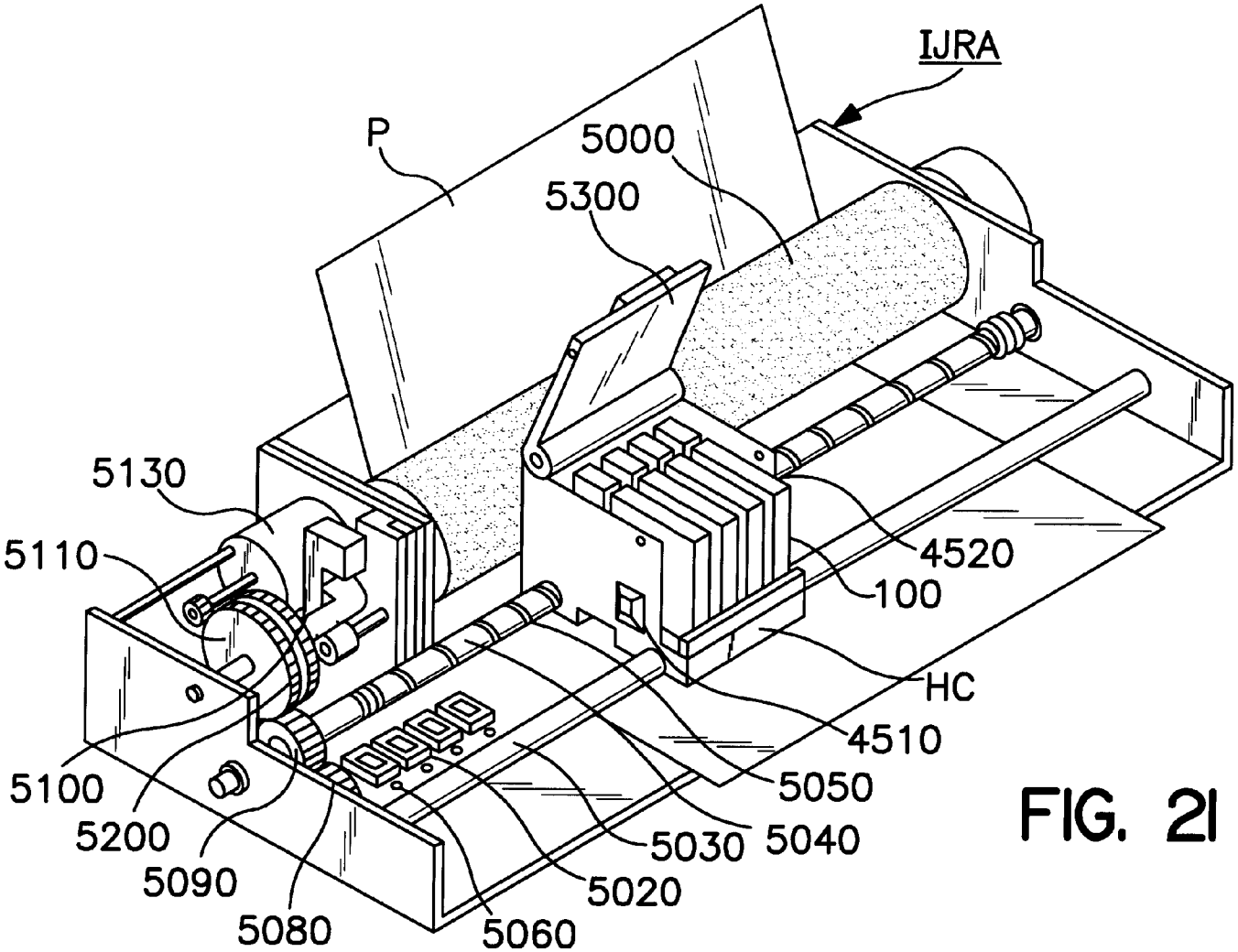
FIG. 21 is a schematic illustration of an example of an ink jet recording apparatus usable with a liquid supply system of the present invention.

The description will be made as to an ink jet recording apparatus for effecting recording with the ink container according to an embodiment of the present invention, shown in FIG. 1. FIG. 21 is a schematic view of an ink jet recording apparatus carrying the ink container according to an embodiment of the present invention. In FIG. 21, a head unit (unshown) and an ink container 100 are detachably mounted on the main assembly of the ink jet recording apparatus by positioning means (unshown) of a carriage 4520 and a connecting plate 5300 rotatable about an axis. The forward and backward rotation of the driving motor 5130 are transmitted to the lead screw 5040 through the drive transmission gears 5110, 5090 to rotate it. The carriage 4520 has a pin (unshown) engaged with the spiral groove 5050 of the lead screw 5040. With this structure, the carriage 4520 is reciprocated in a longitudinal direction of the apparatus.

Designated by 5020 is a cap for caping a front side of each of the recording heads of the recording head unit, and is used for suction recovery for the recording head through an opening in the cap by unshown suction means. The cap 5020 is moved by driving force transmitted through the gear 5080 or the like to cover the ink ejection outlets of each of the recording heads. Adjacent the cap 5020, there is provided a cleaning blade which is supported for vertical movement. The blade is not limited to the one disclosed, but any known cleaning blade is usable.

The capping, cleaning and suction recovery are actuated by the lead screw 5050 when the carriage 4520 moves to the home position at the respective positions. Any other means is usable for this purpose. The description will be made as to advantages when the ink container of the present invention is carried on such a reciprocable carriage.

The ink accommodating chamber of the ink container of the present invention is deformable, and therefore, the motion of the ink caused by the scanning of the carriage can be accommodated by the deformation of the ink accommodating portion. In order to prevent the negative pressure variation against the scanning of the carriage, it is desirable that a part of the corner portions of the ink accommodating portion is not separated from the inner surface of the casing or that it is close thereto, even if they are separated. In the case of an ink accommodating portion having opposite maximum area sides as in this embodiment, when the container is carried on the carriage such that maximum area sides are substantially perpendicular to the scanning moving direction, the ink motion easing effect is particularly significant.

As described in the section of (Structure of ink accommodating chamber), the recording device may be provided with pressing refreshing means 4510 for pressing the inner wall through the outer wall of the ink accommodating chamber. In this case, there may be provided liquid presence or absence detecting means 5060 including light emitting means and receiving means whereby light is passed through the ink accommodating chamber and is received by the light reflected to detect the presence or absence of the ink, ejection failure detecting means(unshown) for detecting ejection failure of the recording head and control means (unshown), so that ink stop from the neighborhood region of the air-liquid exchange path of the negative pressure producing member to the neighborhood region of the ink supply port using the following sequence for example.

In the case that ink accommodating chamber is exchanged, after the normal suction recovery process using the cap 5020, the ejection of the recording head using the exchanged ink accommodating chamber is checked. If the ejection failure is detected, pressing refreshing operation is carried out using the pressing refreshing means 4510 by which normal state is restored. In the case that during the operation, the liquid presence or absence detection detecting means may detect the presence of the ink in an ink container, whereas the ejection failure detecting means detects the ejection failure in the recording head using the container, the normal suction recovery process is carried out. If the ejection failure continues even after the normal suction recovery process, the pressing refreshing operation using the pressing refreshing means 4510 may be carried out. In any case, the recording head corresponding to the ink container subjected to the pressurizing recovery, is covered by the cap, so that unintended ink leakage through the recording head is prevented. The liquid presence or absence detection detecting means is not limited to the above-described optical, but may be a dot count type or another type, or combination thereof. As described in the foregoing, the liquid containing portion deforms such that balance is kept with the negative pressure of the negative pressure producing member, and therefore, even if the air in the liquid containing portion expands due to the ambient condition change, the liquid containing portion restores to toward the initial size and volume if the change is abrupt, thus minimizing the influence of the ambience change. If the change in the ambience is not abrupt, the influence of the expansion is removed eventually both by the negative pressure producing member and the liquid containing portion while the balance is maintained with the negative pressure producing member. Therefore, the required size of the buffer space in the negative pressure producing material chamber can be reduced under various using conditions.

In the second liquid supply process, the air is introduced into the liquid containing portion, so that liquid in the liquid containing portion is used up substantially without an unusably remaining amount ink, and the negative pressure difference between at the time of the start of the liquid discharge from the liquid containing portion and at the time of the end thereof, can be smaller than that when the liquid containing portion alone is used as a negative pressure producing container. As compared with the conventional type ink container having the negative pressure producing material chamber, the ink accommodating chamber and the communication port therebetween, the allowance to the air expansion is larger. Even if a large amount of the ink is consumed in a short period of time, the liquid supply from the liquid containing portion into the negative pressure producing material chamber is smooth since the liquid containing portion is deformable. Therefore, the ink supply is stabilized when the ink in the liquid containing portion is consumed. According to this system, even if the accommodating container for the negative pressure producing material does not contain the liquid in the neighborhood of the communicating portion to the liquid accommodating container, the liquid can be moved from the liquid accommodating container into the negative pressure producing member using the capillary force in the negative pressure producing material chamber upon the mounting of the liquid accommodating container to the negative pressure producing material chamber, so that liquid in the exchanged liquid accommodating container can be assuredly used by the simple mounting, irrespective of the liquid retaining state of the negative pressure producing member adjacent the connecting portion. Thus, a practical liquid supply system with stabilized liquid supply can be provided.

According to the present invention, the ink can be used from the ink accommodating portion without introducing the air into the ink accommodating portion, an ink container and an ink supplying system with high ink accommodation efficiency, usage efficiency and with high immunity against ambient condition change can be provided. Therefore, the size of the container can be downsized, and the running cost can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A liquid supply method, comprising:

a step of preparing a negative pressure producing material chamber, including a liquid supply portion for permitting supply of liquid to an outside and an air vent for fluid communication with an ambient, for accommodating a negative pressure producing member for retaining the liquid;

a step of preparing a liquid containing chamber that includes a liquid containing portion for accommodating the liquid, the liquid containing portion forming a substantially sealed space except for fluid communication with the negative pressure producing material chamber;

a first liquid supply step of permitting the liquid to be supplied to the outside by permitting movement of the liquid into the negative pressure producing material chamber from the liquid containing portion without introduction of air from the negative pressure producing material chamber into the liquid containing portion with a negative pressure while permitting decrease of a volume of the liquid containing portion;

a second liquid supply step, after said first liquid supply step, of permitting the liquid to be supplied to the outside by permitting movement of the liquid into the negative pressure producing material chamber from the liquid containing portion with introduction of air from the negative pressure producing material chamber into the liquid containing portion.

2. A method according to claim 1, wherein said second liquid supply step is carried out while the liquid containing portion deforms within an elastic deformation range.

3. A liquid supply system, comprising:

a liquid supply container that includes a liquid containing portion for accommodating liquid in a sealed space;

a negative pressure producing material container, which accommodates a negative pressure producing member and which is detachably mountable relative to said liquid supply container, said negative pressure producing material container effecting an air-liquid exchange, such that air is introduced into said liquid containing portion and liquid is discharged through a communicating portion communicating with the liquid containing portion, wherein the liquid containing portion of said liquid supply container produces a negative pressure while deforming, and when said liquid supply container is mounted to said negative pressure producing material container, the liquid is permitted to move from the liquid containing portion into said negative pressure producing material container.

4. A system according to claim 3, wherein said negative pressure producing material container is in a state to perform an air-liquid exchange when the liquid supply container is mounted to said negative pressure producing material container.

5. A system according to claim 3, wherein after said liquid supply container is mounted to said negative pressure producing material container, supply of the liquid is permitted to the outside by permitting movement of the liquid into said negative pressure producing material container from the liquid containing portion without introduction of air into the liquid containing portion with a negative pressure while permitting decrease of a volume of the liquid containing portion.

6. A system according to claim 3, wherein, when said liquid supply container is mounted to said negative pressure producing material container, the liquid containing portion is pressurized.

7. A system according to claim 3, wherein a liquid accumulating portion is provided at an end of the communicating portion.

8. A system according to claim 3, wherein said negative pressure producing material container is provided with a guiding member for guiding mounting of the liquid containing portion.

9. A system according to claim 3, further comprising a seal member for substantially hermetically sealing the liquid containing portion except for the communicating portion.

10. A liquid container, comprising:

a negative pressure producing material chamber, including a liquid supply portion for permitting supply of liquid to an outside and an air vent for fluid communication with an ambient, for accommodating a negative pressure producing member for retaining the liquid; and a liquid containing chamber that includes a liquid containing portion for accommodating the liquid, the liquid containing portion forming a substantially sealed space except for fluid communication with said negative pressure producing material chamber, wherein the liquid containing portion deforms with discharge of the liquid therefrom while producing a negative pressure.

11. A container according to claim 10, wherein said negative pressure producing material chamber is provided with a wall extending upwardly from a communicating portion and an ambient introduction path, extended from a position partly up the wall toward a fluid communication path between the wall and the negative pressure producing member, for introducing the ambient into said liquid containing chamber.

12. A container according to claim 10, further comprising a portion not filled with the liquid adjacent said air vent of said negative pressure producing material chamber.

13. An ink jet cartridge, comprising:

a recording head for ejecting liquid to an outside;

a negative pressure producing material chamber, including a liquid supply portion for permitting supply of liquid to said recording head and an air vent for fluid communication with an ambient, for accommodating a negative pressure producing member for retaining the liquid; and a liquid containing chamber that includes a liquid containing portion for accommodating the liquid, the liquid containing portion forming a substantially sealed space except for fluid communication with the negative pressure producing material chamber, wherein the liquid containing portion deforms with discharge of the liquid therefrom while producing a negative pressure.

14. A liquid accommodating container detachably mountable relative to a negative pressure producing material container, which includes a liquid supply portion for supplying liquid to an outside and an air vent for fluid communication with an ambient, for accommodating a negative pressure producing member for retaining the liquid, said liquid accommodating container comprising:

a liquid containing portion for accommodating the liquid, and forming a substantially sealed space except for fluid communication with the negative pressure producing material chamber, the liquid containing portion deforming with discharge of liquid therefrom while producing a negative pressure; and sealing means for sealing a communicating portion relative to said negative pressure producing material container.

15. A container according to claim 14, wherein said liquid containing portion is elastically deformable.

16. A container according to claim 14, wherein the liquid containing portion is provided with a seal member for providing a substantially sealed space except for the communicating portion.

17. A liquid accommodating container detachably mountable relative to a negative pressure producing material container, which includes a liquid supply portion for supplying liquid to an outside and an air vent for fluid communication with an ambient, for accommodating a negative pressure producing member for retaining the liquid, said liquid accommodating container comprising:

a liquid containing portion for accommodating the liquid, and forming a substantially sealed space except for fluid communication with the negative pressure producing material container, the liquid containing portion deforming with discharge of liquid therefrom while producing a negative pressure;

a casing with an inner shape substantially equivalent to an outer shape of said liquid containing portion and including an air vent for introducing the ambient; and sealing means for sealing a communicating portion relative to the negative pressure producing material container.

18. A container according to claim 17, wherein, when said liquid accommodating container is mounted to the negative pressure producing material container, said sealing means is unsealed by the negative pressure producing member at the communicating portion.

19. A container according to claim 17, wherein said liquid containing portion is filled with the liquid, and an internal pressure of the liquid containing portion is negative relative to an atmospheric pressure before mounting to the negative pressure producing member.

20. A container according to claim 17, wherein said liquid containing portion is provided with a seal member for providing a substantially sealed space except for the communicating portion.

21. A container according to claim 17, wherein said liquid containing portion is of substantially a polygonal prism shape, and wherein each of a plurality of walls constituting sides of the polygonal prism shape has a thickness that is thinner at corner portions than at central portions thereof.

22. A container according to claim 21, wherein a side of polygonal prism shape not having a maximum area is provided with a pinch-off portion where the plurality of walls constituting said liquid containing portion are integral and sandwiched by said casing.

23. A container according to claim 21, wherein said liquid containing portion includes opposite sides, which have a maximum surface area, and wherein an air-liquid exchange for permitting discharge of the liquid by introduction of air through the communicating portion with the negative pressure producing material container is started before the sides of the maximum surface area are contacted to each other due to discharge of the liquid from said liquid containing portion.

24. A liquid accommodating container detachably mountable relative to a plurality of negative pressure producing material containers, each including a liquid supply portion for supplying liquid to an outside and an air vent for fluid communication with an ambient, and each for accommodating a negative pressure producing member for retaining the liquid, said liquid accommodating container comprising:

a plurality of liquid containing portions for accommodating the liquid, each of which each forms a substantially sealed space except for fluid communication with a negative pressure producing material container and each such liquid containing portion deforming with discharge of liquid therefrom while producing a negative pressure;

a casing covering said plurality of liquid containing portions and provided with an air vent for introducing the ambient; and sealing means for sealing a communicating portion relative to each of the plurality of negative pressure producing material containers.

25. A container according to claim 24, wherein each of said plurality of liquid containing portions is provided with a seal member for providing a substantially sealed space except for the communicating portion.

26. A head cartridge, comprising:

a recording head for ejecting liquid;

a negative pressure producing material chamber, including a liquid supply portion for permitting supply of the liquid to said recording head and an air vent for fluid communication with an ambient, for accommodating a negative pressure producing member for retaining the liquid; and a liquid containing chamber that includes a liquid containing portion for accommodating the liquid, the liquid containing portion forming a substantially sealed space except for fluid communication with said negative pressure producing material chamber, wherein the liquid containing portion deforms with discharge of the liquid therefrom while producing a negative pressure, and wherein said recording head and said negative pressure producing material chamber are integral with each other.

27. A head cartridge according to claim 26, wherein said liquid containing chamber is detachably mountable relative to said negative pressure producing material chamber.

28. A head cartridge according to claim 26, further comprising a guiding member for guiding said liquid containing chamber.

29. A head cartridge according to claim 26, wherein the liquid containing portion is provided with a seal member for providing a substantially sealed space except for a communicating portion.

30. A head cartridge according to claim 26, wherein said head cartridge comprises a plurality of negative pressure producing material chambers and a corresponding number of recording heads.

31. A liquid supply method, comprising:

a step of preparing a negative pressure producing material chamber that includes a liquid supply portion for permitting supply of liquid to an outside and an air vent for fluid communication with an ambient, for accommodating a negative pressure producing member for retaining the liquid;

a step of preparing a liquid containing chamber that includes a liquid containing portion for accommodating the liquid, the liquid containing portion forming a substantially sealed space except for fluid communication with the negative pressure producing material chamber;

a step of moving the liquid from the liquid containing portion into the negative pressure producing material chamber without introduction of air from the negative pressure producing material chamber into the liquid containing portion with a negative pressure while permitting decrease of a volume of the liquid containing portion.

* * * * *

UNITED STATES PATENT AND TRADEMARK OFFICE

CERTIFICATE OF CORRECTION

PATENT NO. : 6,345,888 B1 
DATED : February 12, 2002
INVENTOR(S) : Hidehisa Matsumoto et al.

It is certified that error appears in the above-identified patent and that said Letters Patent is hereby corrected as shown below:

Title page,
Item [56], References Cited, FOREIGN PATENT DOCUMENTS, "EP 738605 10/1996" should be deleted; and
"7068778" should read -- 7-68778 --.

Column 1,
Line 39, "Ink" should read -- ink --;
Line 46, "o" should read -- ink container --; and
Line 48, "go" should read -- to go --.

Column 2,
Line 17, "expands" should read -- expand --; and
Line 52, "a" (second occurrence) should be deleted.

Column 3,
Line 1, "It is a further object of the present invention to provide a" should be deleted.

Column 6,
Line 2, "illustration" should read -- illustrations --;
Line 37, "at" should read -- as --; and
Line 53, "(0P<1)" should read -- (0<P<1) --.

Column 10,
Line 6, "rom" should read -- from --; and
Line 23, "into" should be deleted.

Column 12,
Line 25, "a n" should read -- an --.

Column 13,
Line 51, "it" should read -- if --; and
Line 56, "despairs," should read -- disappears --.

Column 14,
Line 19, "depend" should read -- depends --; and
Line 43, "restores," should read -- restore, --.

Column 16,
Line 11, "has be" should read -- has to be --; and
Line 35, "shows" should read -- show --.

UNITED STATES PATENT AND TRADEMARK OFFICE

CERTIFICATE OF CORRECTION

PATENT NO. : 6,345,888 B1
DATED : February 12, 2002
INVENTOR(S) : Hidehisa Matsumoto et al.

It is certified that error appears in the above-identified patent and that said Letters Patent is hereby corrected as shown below:

Column 17,
Line 6, “Is” should read -- is --;
Line 27, “In this” should read -- This --; and
Line 52, “(FIG. 8a region),” should read -- (FIG. 8a region). --.

Column 20,
Line 5, “In” (first occurrence) should read -- in --;
Line 39, “Period” should read -- period --;
Line 53, “ton” should read -- on --; and
Line 60, “b e” should read -- be --.

Column 21,
Line 8, “i n” should read -- in --.

Column 22,
Line 30, “illustrates” should read -- illustrate --; and
Line 59, “i” should read -- in --.

Column 23,
Line 40, “per se As” should read -- per se. As --;
Line 65, “((0<P<1)” should aread -- (0<P<1) --; and
Line 66, “((0≦a≦1)” should read -- (0≤a≤1) --.

Column 26,
Line 13, “then” should read -- than --.

Column 28,
Line 2, “recess” should read -- recess 111B --.

Column 29,
Line 11, “Ink” should read -- ink --; and
Line 60, “thedegree” should read -- the degree --.

Column 30,
Line 7, “a” should be deleted;
Line 8, “connected” should read -- connected to --;
Line 17, “presses” should read -- pressing --;
Line 22, “art” should read -- part --;
Line 23, “f” should read -- of --; and
Line 33, “repeated This” should read -- repeated. This --.

UNITED STATES PATENT AND TRADEMARK OFFICE

CERTIFICATE OF CORRECTION

PATENT NO. : 6,345,888 B1 
DATED : February 12, 2002
INVENTOR(S) : Hidehisa Matsumoto et al.

It is certified that error appears in the above-identified patent and that said Letters Patent is hereby corrected as shown below:

Column 35,
Line 24, "portion;" should read -- portion; and --.

Column 37,
Line 67, "each" (second occurrence) should be deleted.

Signed and Sealed this

Sixth Day of May, 2003

JAMES E. ROGAN
*Director of the United States Patent and Trademark Office*